United States Patent [19]

Hurst et al.

[11] 4,111,332

[45] Sep. 5, 1978

[54] ARTICLE COUNTING DEVICE

[76] Inventors: Kerney J. Hurst, Rte. 1, Box 172-L; Walter G. Pearson, 104 Hilltop Dr., both of Pineville, La. 71360

[21] Appl. No.: 533,255

[22] Filed: Dec. 16, 1974

Related U.S. Application Data

[63] Continuation of Ser. No. 288,737, Sep. 13, 1972, abandoned, which is a continuation-in-part of Ser. No. 187,771, Oct. 8, 1971, abandoned, which is a continuation-in-part of Ser. No. 25,709, Apr. 6, 1970, abandoned.

[51] Int. Cl.[2] ..... B65B 57/20

[52] U.S. Cl. ..... 221/7; 221/125; 221/186; 221/287

[58] Field of Search ..... 133/8; 221/2, 7, 13, 221/125, 129, 169, 182, 263, 265, 277, 186, 287; 194/10

[56] References Cited

U.S. PATENT DOCUMENTS

| | | | |
|---|---|---|---|
| 2,025,273 | 12/1935 | Dellaree | 221/169 |
| 3,232,400 | 2/1966 | Hendrickson | 221/129 X |
| 3,302,828 | 2/1967 | Gomez et al. | 221/2 |
| 3,349,881 | 10/1967 | Camp | 221/125 X |
| 3,368,713 | 2/1968 | Hurst et al. | 221/7 |
| 3,612,073 | 10/1971 | Calos | 133/8 R |
| 3,691,431 | 9/1972 | Hendrickson et al. | 194/10 X |

*Primary Examiner*—Robert B. Reeves
*Assistant Examiner*—Francis J. Bartuska
*Attorney, Agent, or Firm*—Rose & Edell

[57] ABSTRACT

A small-article receiving hopper is mounted on the upper surface of an inclined support and is rotated by connection with the drive shaft of a motor projecting through the support. The disk-like bottom of the hopper is undercut to form a circumferential series of radial and angularly spaced article receiving slots with the innermost end of the slots in overlying relation with respect to an outlet opening formed in the support. A centralized electrical control means controls operation of a selected motor hopper of a plurality of motors, each associated with a different hopper for dispensing different drugs. The motor of the selected hopper is rotated until a desired number of pills is dispensed and is then stopped.

37 Claims, 16 Drawing Figures

FIG. 10

NARROW MS ← | → WIDE MS

| | | | | | | | | | | | | | | | | | | |
|---|---|---|---|---|---|---|---|---|---|---|---|---|---|---|---|---|---|---|
| TABLET DIAMETERS | .190<br>.178- | .204<br>.191- | .219<br>.205- | .236<br>.220- | .253<br>.237- | .271<br>.254- | .290<br>.272- | .311<br>.291- | .333<br>.312- | .357<br>.334- | .382<br>.358- | .410<br>.383- | .439<br>.411- | .470<br>.440- | .503<br>.471- | .538<br>.504- | .577<br>.539- | .617<br>.578- |
| DISC Nº. AND PLATFORM | 1-A | 2-A | 3-A | 4-A | 5-A | 6-A | 7-A | 8-B | 9-B | 10-B | 11-B | 12-B | 13-B | 14-B | 15-C | 16-C | 17-C | 18-C |
| SLOT DEPTHS (th = .40dia) [LOW END] (th = .65dia) [HIGH END] (th. t .010") | d .123<br>.107- | d .133<br>.115- | d .142<br>.123- | d .153<br>.133- | d .164<br>.142- | d .176<br>.152- | d .188<br>.163- | d .202<br>.174- | d .216<br>.187- | d .232<br>.200- | d .248<br>.214- | d .266<br>.230- | d .285<br>.246- | d .305<br>.263- | d .327<br>.282- | d .350<br>.302- | d .375<br>.323- | d .401<br>.345- |
| | m .106<br>.090- | m .114<br>.096- | m .122<br>.103- | m .132<br>.112- | m .141<br>.119- | m .151<br>.127- | m .162<br>.137- | m .173<br>.145- | m .186<br>.157- | m .199<br>.169- | m .213<br>.179- | m .229<br>.193- | m .245<br>.206- | m .262<br>.220- | m .281<br>.236- | m .301<br>.253- | m .322<br>.270- | m .344<br>.288- |
| | s .089<br>.073- | s .095<br>.077- | s .102<br>.083- | s .111<br>.091- | s .118<br>.096. | s .126<br>.102- | s .136<br>.111- | s .144<br>.116- | s .156<br>.127- | s .166<br>.134- | s .178<br>.144- | s .192<br>.156- | s .205<br>.166- | s .219<br>.177- | s .235<br>.190- | s .252<br>.204- | s .269<br>.217- | s .287<br>.231- |
| | t .072<br>.052- | t .076<br>.058- | t .082<br>.063- | t .090<br>.070- | t .095<br>.073- | t .101<br>.077- | t .110<br>.085- | t .115<br>.087- | t .126<br>.097- | t .133<br>.101- | t .143<br>.109- | t .155<br>.119- | t .165<br>.126- | t .176<br>.134- | t .189<br>.144- | t .203<br>.155- | t .216<br>.164- | t .230<br>.174- |
| SLOT WIDTH (dia.+15dia.) [HIGH END-RANGE | .218 | .235 | .252 | .271 | .291 | .312 | .333 | .358 | .383 | .410 | .428 | .459 | .492 | .525 | .562 | .602 | .646 | .692 |
| SLOT SECT 41 RADIUS OF INNER MOST PART (1.802-.666dia.) [CENTER-RANGE | 1.679 | 1.671 | 1.661 | 1.650 | 1.639 | 1.628 | 1.615 | 1.602 | 1.588 | 1.572 | 1.556 | 1.538 | 1.519 | 1.499 | 1.478 | 1.455 | 1.430 | 1.404 |
| SLOT SECT. 41 ANGLE FROM RADIAL LINE | 20 DEGREES | | | | | | | | | | | | | | | | | |
| SLOT SECT 41 : LENGTH (2dia+.010) [HIGH END] | .390 | .418 | .448 | .482 | .516 | .552 | .590 | .632 | .676 | .724 | .774 | .830 | .888 | .950 | 1.016 | 1.086 | 1.164 | 1.244 |
| SLOT SECT. 39 ANGLE from FIRST SLOT | 60 DEGREES | | | | | | | | | | | | 55 DEGREES & 5/32" GUARD CUT | | | | | |
| SLOT SECT 39-RADIUS of OUTERMOST PART (3.430 fin. lgth) | 3.162 | 3.145 | 3.128 | 3.109 | 3.089 | 3.068 | 3.047 | 3.022 | 2.997 | 2.970 | 2.952 | 2.921 | 2.888 | 2.855 | 2.818 | 2.778 | 2.734 | 2.688 |
| SLOT SECT 38-ANGLE from RADIAL LINE | 10 DEGREES REVERSE | | | | | | | | | | | | | | | | | |
| SLOT SECT 38-FIN. LGTH. (SLOT width + .0501-6<br>.0607-11<br>.07012-18 | .268 | .285 | .302 | .321 | .341 | .362 | .393 | .418 | .443 | .470 | .488 | .519 | .562 | .595 | .632 | .672 | .716 | .762 |

ARTICLE COUNTING DEVICE

CROSS REFERENCE

This application is a continuation of Ser. No. 288,737 filed Sept. 13, 1972, now abandoned, which was a continuation-in-part of our co-pending application Ser. No. 187,771, filed Oct. 8, 1971, now abandoned, which was a continuation-in-part of our co-pending application Ser. No. 25,709, filed Apr. 6, 1970, now abandoned.

BACKGROUND OF THE INVENTION

The present invention relates to machines for counting small articles and more particularly to a counter for tablets and capsules commonly referred to as drug items.

Valuable time is used by pharmacists in the tedious operation of counting out the exact number of tablets or capsules required to fill individual prescriptions. This time could be well utilized by the pharmacist in filling out the label or instructions for the user, in receiving telephone prescriptions from a physician, or in performing many of the other activities that can only be done by a Registered Pharmacist. The high volume of prescriptions now being filled by pharmacists make it desirable to provide a means for accurately counting out the required number of tablets or capsules for each particular prescription. Furthermore, some drug items may be purchased in bulk quantity which are then counted into groups and packaged in smaller containers for resale. This invention provides such a counting function.

The prior art reveals a number of counting machines designed to count a predetermined number of pills or tablets, some of which deposit the respective pills or tablets in a separate container, which are conveyed by the counting device. Some of the prior art machines are intended for the use of manufacturers where the articles are packaged in large quantity for bulk distribution rather than by the use of an individual pharmacist in filling a prescription for a relatively small number of pills or tablets.

The most pertinent of the prior art patents is U.S. Pat. No. 3,368,713, issued to us Feb. 13, 1968, for Article Counting Device.

The present invention is an improvement over our above named patent by changing the configuration and angular position of tablet or capsule receiving slots formed in the disk-like bottom of a rotating article holding hopper so that only one tablet or capsule will be positioned for contacting and tripping a switch as the tablet or capsule falls through a dispensing opening so that at the last moment before the switch contact occurs, a tablet cannot dart into the inward end of the slot far enough to trip the counting switch but not far enough to stay in position to drop out of the dispensing opening, which would result in an inaccurate count. Also the improved design prevents any tendency of tablets or capsules to bind or crush. Furthermore, it has been found that occasionally a single tablet or capsule may trip the counting switch more than one time during its passage from the slot of the disk through the exit opening thereby resulting in an inaccurate count. Provision has been made in the electrical circuit of this device to eliminate inaccurate counts of this nature.

Most of the prior art counting machines provide a single hopper which must be emptied and refilled with the tablets or capsules to be counted and various settings arranged for the passage of the particular size capsule or tablet. This invention contemplates using a separate hopper for each individual group of tablets or capsules so that the counting action may be achieved by simply setting the desired quantity and pressing a start switch. Each hopper is permanently sized and adjusted for its particular size and shape tablet or capsule.

SUMMARY OF THE INVENTION

A tablet or capsule containing hopper flatly contacts an inclined support and is rotated on the support by a motor shaft projecting through the support and engaging the hopper. The disk-like bottom of the hopper is undercut to form radial and angular outwardly open grooves or slots for receiving a tablet or capsule by rotation of the hopper and successively passing the innermost end portion of the respective slot over an opening formed in the support. A switch, mounted on the support adjacent the opening, is tripped by the passage of a tablet or capsule, before it falls by gravity through the opening, for operating an electrical counting means. Various different disks are provided to accommodate tablets as opposed to capsules and to accommodate different sizes of tablets and capsules. The various configurations of the slots are such as to prevent jamming of the slots to assure rapid dispensing and to prevent more than one tablet or capsule being positioned in the inward end portion of any one slot thus insuring that only one tablet or capsule may pass through the dispensing opening as the slots are successively rotated thereacross. Further the configuration of the slots is such as to insure that a tablet or capsule acquired at the outer end of the slot arrives at the innermost end of the slot prior to the innermost end arriving at the drop-out hole. The outer ends of the slots are configured to clear jams at the outer locations which might occur when two capsules or tablets are acquired at the same time and concurrently to maximize the rate at which the capsule or tablet are acquired. Alternatively the platform is spring biased against the bottom of the hopper to achieve the same result.

The invention further comprises novel circuits for controlling the dispensing of capsules or tablets. The circuit provides a mechanism, for instance, push buttons, for inserting into a storage member of a central control unit for a plurality of drug dispensing cells, the number of pills to be dispensed. A start button may then be depressed at the drug cell containing the particular drug to be dispensed. Operation of the start button energizes the drug cell motor for rotating the disk of the selected cell and also energizes several control elements at the control station to permit counting of the pills as dispensed and to prevent other drug cells from being placed in the pill dispensing condition. Upon operation of the start button, as indicated above, pills are dispensed from the selected drug cell until the desired count is attained; totalizing of the count being accomplished by appropriate mechanical counters or other forms of totalizers located in the central control unit. When the accumulated count of dispensed pills equals the preselected count operation of the selected cell is discontinued and the counter is automatically reset to zero. The cycle may then be repeated with the same or a different drug cell using the same or a different count.

It is an object of the present invention to provide novel configurations of tablet or capsule receiving slots in a rotatable disk for accurately dispensing such items one at a time so that accurate and reliable counting of dispensed items may be accomplished.

It is another object of the present invention to provide a slotted disk for acquiring tablets or capsules at a rapid rate, to prevent jamming of the tablets or capsules in the slots by providing a self clearing action and to insure dispensing of only one tablet or capsule at a time.

Still another object of the present invention is to provide a series of slotted disks for dispensing tablets of progressive ranges of sizes, and to provide the basic formulations employed to calculate the slot sizes and angles for each of the various ranges of tablet sizes.

Another object of the present invention is to provide a series of slotted disks for dispensing capsules of progressive ranges of sizes.

It is still another object of the present invention to provide an inclined platform for receiving a pill dispensing hopper wherein the platform is spring biased against a slotted pill dispensing disk forming the bottom of the hopper whereby to insure intimate contact between the disk and platform to minimize problems with jamming of tablets or capsules at the entrance to the slots formed in the disk.

Yet another object of the present invention is to provide central control and drug cell circuitry for a pill dispenser which circuitry permits selection of the number of pills to be dispensed, permits selection of one of a plurality of different drug cells for operation, prevents operation of all other drug cells during operation of the selected cell, counts the number of pills dispensed and stops operation of the selected cell when the selected number of pills has been dispensed.

BRIEF DESCRIPTION OF THE DRAWINGS

The above and still further objects, features and advantages of the present invention will become apparent upon consideration of the following detailed description of specific embodiments thereof, especially when taken in conjunction with the accompanying drawings, wherein:

FIG. 10 is a table illustrating various dimensions of the disk illustrated in FIGS. 2–5;

DESCRIPTION OF THE PREFERRED EMBODIMENTS

Figure 1:
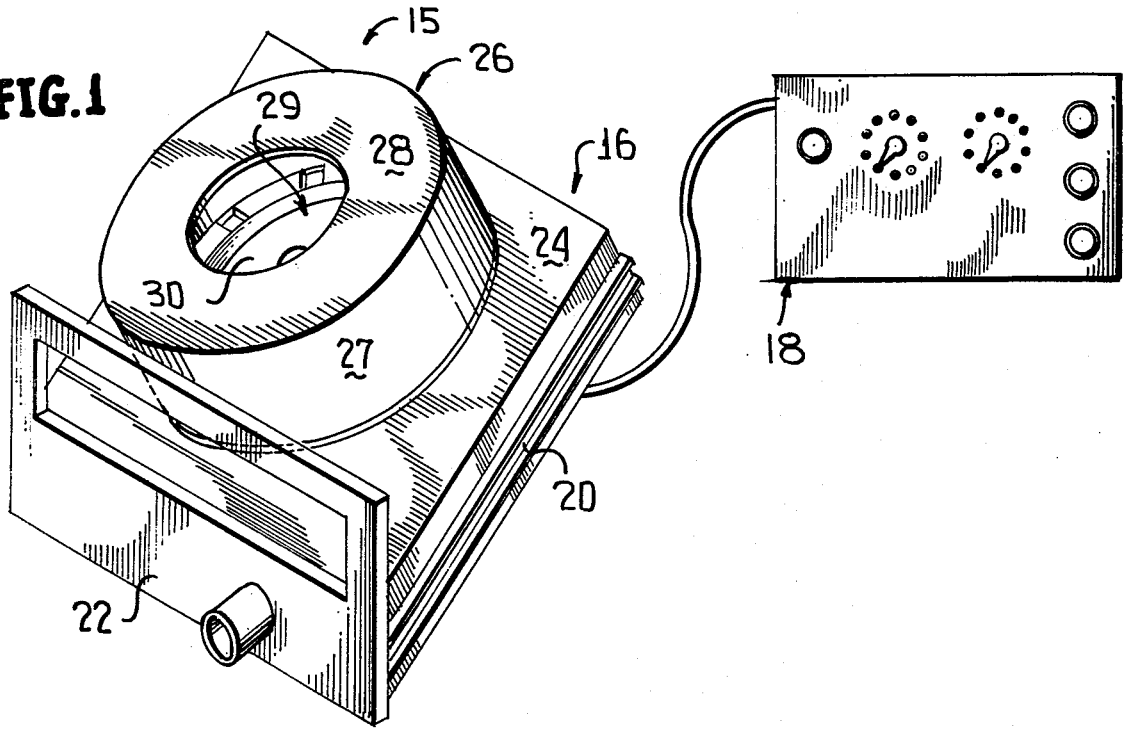
FIG. 1 is a perspective view of the article holding hopper and its support connected with a counting control unit shown in elevation.

Like characters of reference designate like parts in those figures of the drawings in which they occur.

The numeral 15 indicates the device, as a whole, comprising an article holding and article dispensing means 16 connected with a counting control means 18. The article holding means 16 is substantially box-like in general configuration adapted to slide into and out of a supporting cabinet, not shown, by sliding rails 20 wherein a front panel 22, forming a cover or front wall of the cabinet, closes an opening in the cabinet to provide a pleasing appearance. The configuration of the article holding means 16 is shown by way of example wherein a plurality of such holding means 16 are positioned in vertical juxtaposed rows so that each of a plurality of such article holding means contains a like plurality of different tablets or capsules. Furthermore, it is desirable that the upper surface of the article holding means form an inclined support 24. This support 24 is preferably of plastic to reduce frictional resistance to tablets or capsules rotated across its surface in the manner presently explained.

A hopper 26 is centrally positioned on the support 24. The hopper 26 is generally cylindrical and is characterized by a vertical wall 27 (FIG. 3) turned inwardly to form a top 28 having a central access opening 29. A circular disk 30 forms the bottom of the hopper.

FIGS. 2, 3, 4 and 5, illustrate the desired configuration of slots or grooves formed in the bottom surface 31 of the disk 30. The thickness of the disk 30 is substantially greater than the thickness of the tablets or capsules to be counted. The disk 30 is shown formed integral with the wall 27 but in practice the disk is formed separately and then bonded by its peripheral edge surface to the inner surface of the wall 27 opposite the opening 29. A peripheral edge portion of the disk 30, opposite its bottom surface 31, is cut away to form a relatively thin section 32, defined by a shoulder 35, which forms a circular lip to receive the vertical wall 27 of the hopper 26 to which the disk 30 is bonded. A further horizontal surface 33 is defined between the shoulder 35 and an upwardly sloping conical surface 36 which terminates in a flat circular upper surface 37. Slots, generally designated by reference numeral 34, have a depth equal to the height of the surface 33 above surface 31 so that the region of the slots lying radially outward from surface 36 are not closed at the top and pills may fall into the slots by gravity feed.

The width of the flat surface 33 is slightly greater than the diameter of the tablets to be dispensed so that the tablets may be readily received in the slots.

The upwardly sloping surface 36 is employed to insure flow of the tablets to the surface 33 as tablets are withdrawn.

The tablet receiving slots 34 are composed of three sections, an innermost section 41 which has an angle of 20° relative to a radius of the disk through the slot section, an outermost section 38 having a 10° reverse angle relative to the radial line of the disk 30, and a second or middle section 39 having in most cases an angle of 60° relative to the center line of slot section 41. The terms "reverse" and "forward" refer to the direction of rotation of the disk 30 which in the illustrated embodiment is clockwise.

Figure 4:
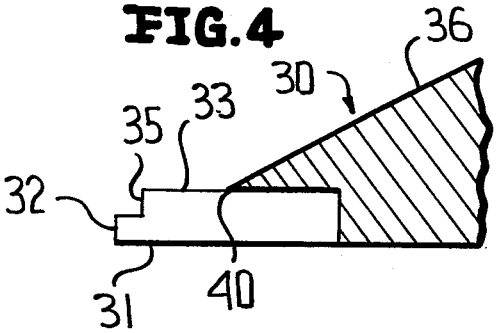
FIG. 4 is a vertical sectional view taken substantially along the line 4—4 of FIG. 2.

Before undertaking a discussion of the angles of the various slot sections, reference is made to FIG. 4 of the accompanying drawings which illustrates a sectional view in elevation of a part of the disk taken through the center of slot entry section 38 of one of the slots. As previously indicated, the slots 34 are provided by undercutting the disk 30 to the depth of the surface 33. Thus the intersection of the sloping surface 36 and the top surface of the slot section 38 provides a sharp edge 40 located inward from the wall 27 by the diameter of the pill plus a small increment for clearance and tolerance.

Figure 2:
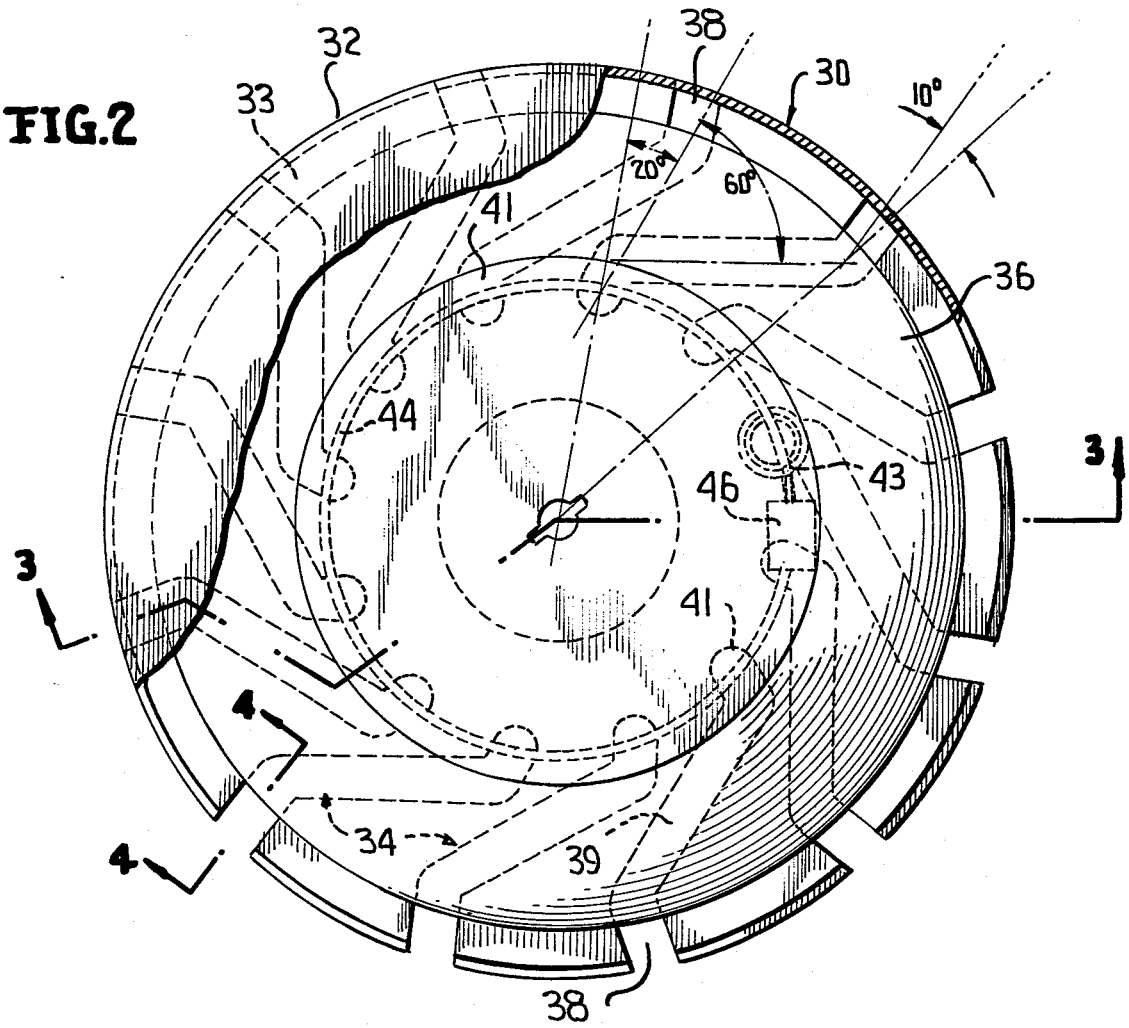
FIG. 2 is a top view of the hopper disk for tablets illustrating, by solid and dotted lines, the respective position of tablets receiving slots and their relation to the exit opening.
Figure 3:
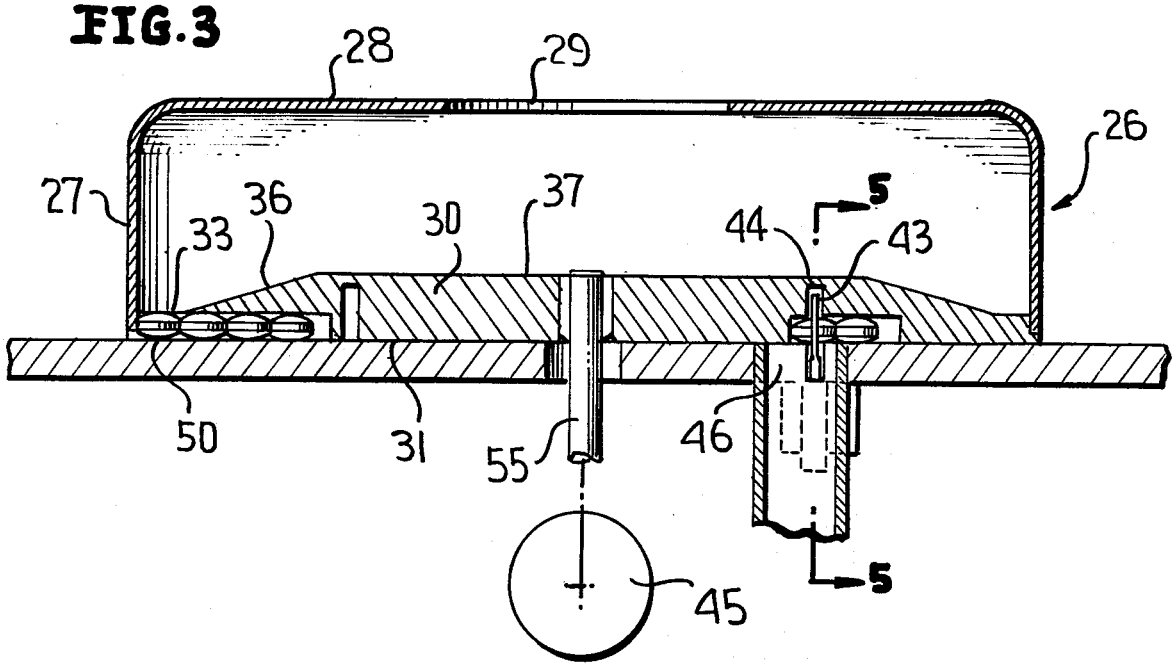
FIG. 3 is a vertical cross-sectional view of the hopper, its support, and the receiving slot area, taken substantially along the line 3—3 of FIG. 2.

Referring now to FIGS. 2 and 3, the disk 30 may acquire tablets at any location about its periphery but movement of a tablet from the section 38 into the section 39 is effected by gravity. Thus inward movement of a tablet normally occurs over the section of the disk in which the sections 38 have a projection on the vertical. In the illustrated embodiment, the above relationship is achieved when the section 38 achieves a position approximately 10° above the horizontal diameter of the disk 30.

Reference is now made to FIG. 2 for a discussion of the angle of the sections 38 of the slots 34. The 10° reverse angle of the section 38 is chosen to help clear jams when and if two tablets attempt to enter the section 38 concurrently either in flat, overlapping relation or on edge side by side. Since the section 38 has a reverse angle, movement of the disk 30 over the bed or top surface 24 of the cell, causes a drag to be exerted on the tablets which is both outward and counter to the direction of movement imparted by rotation of the disk. The force of the drag tends to move the tablets radially outward to free them from the sharp edge 40. The choice of the angle is determined by providing sufficient outward thrust to be effective when gravity cannot effect inward movement due to jamming but not so large as to retard significantly inward movement of a single tablet under the force of gravity when the tablets are free to fall due to gravity. The angle of 10° has been found to achieve the desired result at the speed of rotation employed, as discussed subsequently.

Figure 5:
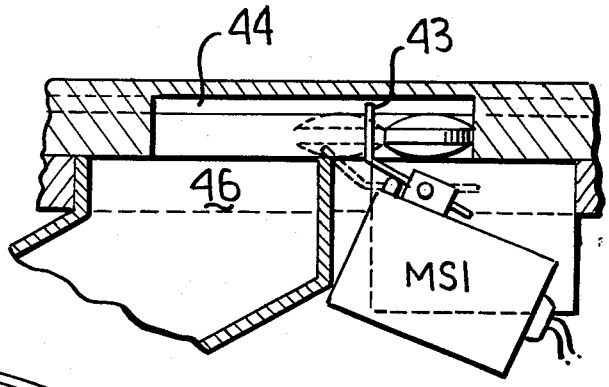
FIG. 5 is a vertical cross-sectional view taken substantially along the line 5—5 of FIG. 3.

Before proceeding to a discussion of the angle of the slot section 39, certain other parts of the apparatus must be considered. Referring to FIGS. 2, 3 and 5, a switch actuator or pill sensor 43 is located to be seated in a circular slot 44 which intersects the slot 34 at about the intersection of the forward walls of slot sections 39 and 41. The actuator 43 is the actuating arm of a microswitch (not illustrated) positioned below the upper bed of the unit 15, the arm extending upper through an appropriately located aperture in registry with the slot 44. When the sensor 43 is moved clockwise it actuates the microswitch (causes its contacts to be closed, for instance) and a count is registered.

It is essential to accurate operation of the mechanism that a tablet that has been counted drop through the drop-out hole designated by reference numeral 46 and located at the 3 o'clock position of the surface 24 and further that only one tablet shall be dispensed. In order to insure the above two factors are involved, namely, the length of the slot section 41 inwardly of the slot 44 must be slightly greater than the radius of the tablet. Specifically when the sensor contacts the tablet it must not exert an outward force on the tablet or it might pop it out of section 41 into section 39 of the slot in which case the tablet does not drop through the hole 46. In order to assure that the tablet remains seated in section 41, the sensor 43 must extend a radial inward force on the tablet. This is accomplished by insuring that over 50% of the tablet is disposed inwardly of the sensor. Further the sensor must not contact a surface of the tablet that exerts a large side thrust thereon since the sensor might bind between the tablet and the wall of slot 44 and not operate or become bent, imparting erractic operation to the apparatus. This factor, which is necessary to achieve the desired operation, is related to the length of slot section 41 and is discussed in greater detail subsequently.

The second factor relating to accurate dispensing is concerned with allowing only one tablet to be dispensed each time a slot is presented to the drop-out hole. As indicated above the slot section 41 lies at an angle of 20° relative to the radius of the disk passing through slot section 41. At this angle the counterclockwise surface of this section of the slot is inclined toward the center of the disk. The drag of the tablet on the surface 24 presses the tablet against the counterclockwise surface of the slot section 41 so that a net inward force is developed which tends to hold the tablet seated at the inner end of the section 41. The force generated is sufficient to overcome the slight force of gravity on the pill which, as the pill approaches the drop-out hole, is outward. Actually the sensor 43 engages the pill before the pill reaches the drop-out hole and at a time when the counterclockwise surface of section 41 is almost horizontal. Thereafter the drag on the tablet and the force exerted by the sensor 43 are both directed inward and more than compensate for any centrifugal and gravity forces that may be encountered.

Directly related to the above fact is that at the time the slot section 41 approaches the drop-out hole, the slot section 39 is angled sharply downward so that the second pill falls away from the section 41 and the possibility that two pills might be dispensed is effectively obviated.

The angle of the slot 39 is determined primarily by the need to insure seating of a tablet in section 41 before this latter section is presented to the sensor 43.

The precise point of entry of a tablet into the section 38 of a slot 34 cannot be determined and may occur at any location where the section 38 has a vertical downward component. The angle of section 39 must be chosen such that a tablet entering section 38 either proceeds to its innermost location before being presented to the sensor 43 or is prevented from reaching the section 41 until after the section 41 has passed the sensor and drop-out hole.

The controlling factors relative to insuring proper seating of the tablet is the average inward velocity of the tablet as determined by the slot angle and the rate of rotation of the disk. Specifically the angle of the slot must be such that the tablet has moved counterclockwise a sufficient distance relative to the last possible position at which a tablet can enter the slot section 38 and still proceed inward to the sensor, that it be seated in the innermost location of the slot while the section is still counterclockwise of the actuator 43. With a rate of rotation of the disk of from 25 to 40 rpm, this angle is about 60°. A greater angle does not provide sufficient inward velocity, which velocity results from a combination of gravity and drag of the base on the tablet, to insure that the necessary conditions are met and a lesser angle provides a velocity such that a last moment "darter" may contact the sensor 43 while most of the tablet is still above the sensor. As is discussed subsequently lesser angles are employed with larger tablets and a guard region is provided which traps the darters before they reach the sensor location.

Listed in Table I of FIG. 10 is a complete set of dimensions of the various slot sections for tablets of various diameters and thicknesses. It will be noted that 72 different disks are desirable to cover the range of sizes of tablets in common use today.

Disk 1-A accepts a range of tablet diameters of 0.178 inches to 0.190 inches, disk 2-A accepts a range of tablet diameters of 0.190 inches to 0.204 inches, etc. The width of the slots are equal to the maximum diameter of a tablet in a range plus 0.15 times said diameter. The disk 1-A is (as are all other disks) subdivided into four categories according to slot depth which is a function of tablet thickness. Disk 1-A designed for use with deep (d) tablets has slot depths of 0.133 inches to accommodate tablets of 0.107 inches–0.123 inches depth; this factor being equal to maximum tablet depth plus 0.01 inches. In the above Table "*m*", "*s*" and "*t*" stand for "medium", "shallow", and "thin".

The radius of the location of the innermost part of slot section 41 is equal to 1.802 inches less 0.666 times the diameter of the middle range of diameters of the tablets for which the disk is designed. For example, the range of the tablet to be dispensed by disk 1-A is 0.178 inches–0.190 inch and its middle range diameter is 0.184 inches. Thus the subtraction factor is 0.123 inches to achieve a radius of 1.679 inches. The disk illustrated in FIG. 2 is disk 6-A so that the radius of the innermost part of slot section 41 is 1.628 inches. The length of slot section 41 is equal to twice the maximum diameter of the tablet in the range plus a fixed factor of 0.01 inches or 0.390 inches for disk 1-A.

The radius of the outer end of the slot section 39 is determined by the length of the slot section 38 which is equal to the slot width plus a factor which varies as a function of tablet diameter. For disks 1A - 6A this factor is 0.05 inches, for disks 7A and 8B to 11B this factor is 0.06 inches and for disks 12B–18C this factor is 0.07 inches. Thus the length of the slot section 38 is the pill diameter plus a tolerance factor.

The radius of the outer end of slot section 39 is equal to the radius of the disk to the shoulder 33, 3.430 inches less the length of slot section 38. All of the above dimensions are approximate; the precise values being subject to normal manufacturing tolerances.

It will be noted that the angles of slot sections 41 and 38 are the same for all disks. This is not true however for the angle of slot section 39 since such angle causes intersection of slot section 39 of one slot with slot section 41 of the next forward slot at the larger diameters. Thus an angle of 55° is employed in the disks for larger diameter pills.

Figure 6:
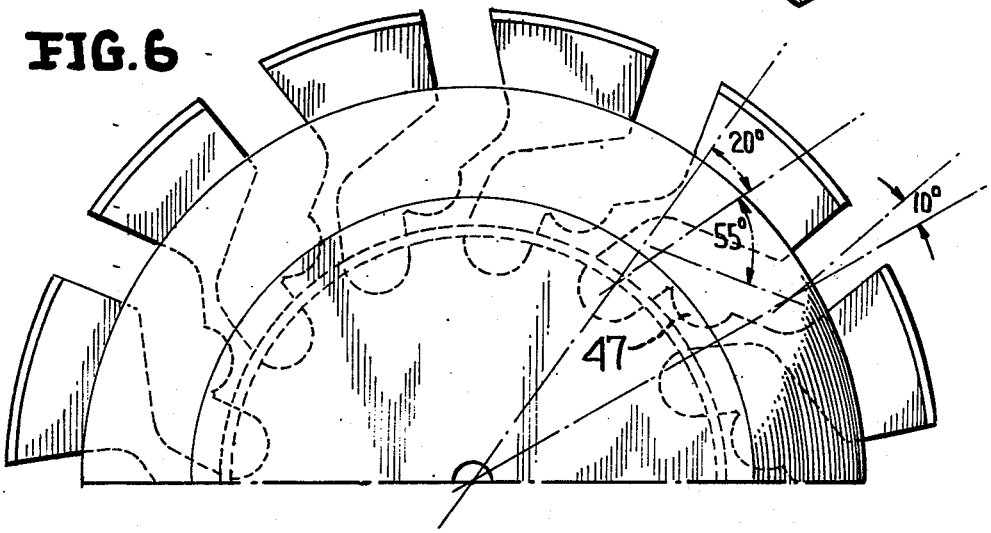
FIG. 6 is a partial top view of a modification of the disk of FIG. 2.

Such a slot angle is insufficient to provide errorless operation and errors can occur due to last minute darters; that is, pills that are picked up at a location such that they fall to the section 41 at about the time this section reaches sensor 43. To prevent problems produced by the darters, a guard section 47 of the section 39 must be employed. Referring specifically to FIG. 6 of the accompanying drawing, the guard section 47 is formed in the wall of the disk defining the side of the slot section 39 toward the direction of rotation of the disk and immediately adjacent the entrance to slot section 41. If a tablet enters the slot 34 when slot section 39 is vertical, the guard section 47 has no effect on travel of the tablet and it should not since ample time is provided for the tablet to achieve its innermost position. As the slot becomes less vertical the tablet engages the forward wall of the slot and the guard section 47 increasingly delays to travel of the tablet. At marginal position of slot section 39, the guard section delays or stops the tablet for a sufficient length of time to eliminate the problem of darters.

Referring now to FIGS. 3 and 5, when motor 45 is energized it drives a shaft 55 to which the disk 30 is keyed. Thus the disk 30 and hopper 26 are rotated and a tablet or tablets 50 may enter the slot 38, shown at the left hand side, as viewed in FIG. 3, and proceed through slot 39 to slot section 41. If two or more tablets enter the slot the two innermost tablets are positioned, as shown by the right hand portion of FIG. 3, wherein the innermost tablet 50 is positioned to intersect the arm 43 of a microswitch MS1 to close the normally open contacts of the microswitch by depressing the arm 43 as the tablet is rotated across the opening 46 where the tablet falls by gravity into a delivery tube 47. As the slot approaches the drop-out hole the outermost tablet 50, shown in the right hand portion of FIG. 3, falls away from the innermost tablet so that two tablets cannot be dispensed.

Figure 7:
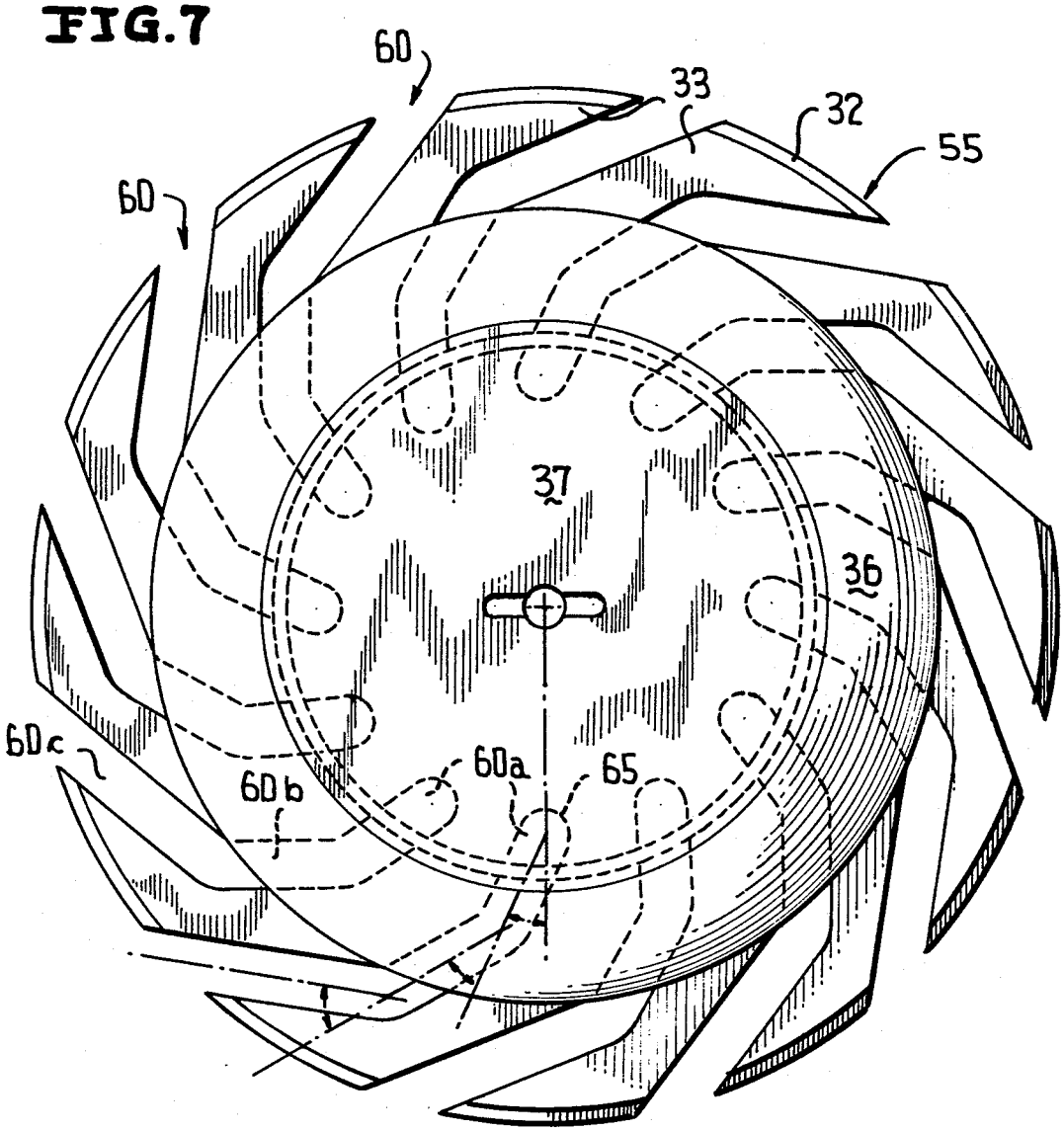
FIG. 7 is a top view of a hopper disk for dispensing capsules illustrating by solid and dashed lines the configuration of the capsule receiving slots formed in the underside of the disk.

Referring now specifically to FIG. 7 there is illustrated a disk 55 suitable for dispensing capsules. The disk is similar to that illustrated in FIGS. 2–4 and provides a flat slotted bottom surface, a lip for receiving the member 27, a surface such as 33, a truncated upper surface comprising surfaces 36 and 37 all as illustrated in the aforesaid figures.

The disk 55 is slotted on its bottom surface to provide a plurality of slots generally designated by the reference numeral 60. The slots comprise three sections 60A, 60B and 60C. The axis of the slot section 60A forms an angle in the range of 20° to 40° with a radius of the disk 55 drawn through the center of the circle defining the semi-circular inner part 65 of the slot section 60A. At the speed of rotation contemplated herein the preferred angle is approximately 25°, this angle being optimum for trouble free operation and capsule feed rate.

The slot section 60B lies adjacent slot section 60A and forms an angle with this latter section which depends upon the angle of the section 60A. If this latter angle is 25° then the angle of section 60B relative thereto is 40°. The total angle of the three sections should be about 100° to maximize feed rate of capsules. Thus the angle between the sections 60B and 60C should, when added to the two aforesaid angles, total 100°. If the section 60A is at 25° to the radius and the section 60B is at 40° relative to section 60A, the section 60C is preferably at an angle of 35° relative to section 60B.

The total angle of 100° provides for good snaring of the capsules and the angle of the center section 60B produces rotation of the capsules resulting in a cork screw effect that helps bring the capsule toward the center at a rapid rate.

A disk formed as above, rotated at from 25 to 60 rpm's feeds capsules at a rate of approximately 300 to 600 per minute and although other arrangements are fully operable, the 25°-40°-35° arrangement provides the rapid feed in the range of 25 to 60 rpm's.

As indicated above the three elements to be considered are the snare rate of the capsules, section 60C at 100° to the radius, the feed rate through section 60B, the rate of feed due to the cork screw feed of the capsules and the angle of section 60A at the microswitch and drop-out hole locations to insure the capsule is properly seated in the section 60A at these locations.

The considerations of the slot width and slot section lengths are much the same as in the disks for the tablets. The slot depth is equal to capsule diameter plus a tolerance equal to a percentage of diameter, for instance, 20%. The first slot is located such that the microswitch contacts the capsule near its center but slightly outward thereof. The length of the first slot is of course a function of capsule length and is somewhat larger than the smallest length capsule so as to accommodate a range of capsules as hereinafter defined. A deviation from the tablet disk occurs when considering slot width. The width must take into account both the capsule diameter and capsule length, the latter due to considerations of the capsules' ability to turn the corners between slot sections. In practice a factor of 0.3 to 0.4 times the capsule length plus capsule diameter has been found satisfactory.

The radius of the outermost part of the middle slot section 60B is a function of the exposed part of the slot and the slot width so as to accommodate the width of slot section 60C and must be longer than the capsule length to permit free flow of the capsules.

It has been found that only six disks are required to accommodate the complete range of standard capsules. The six disks accommodate capsules having nominal lengths in inches of 0.51, 0.58, 0.65, 0.72, 0.79 and 0.88 respectively.

It is thus seen that the apparatus of the present invention can accommodate the vast majority of pills presently on the market utilizing only 78 different disks. Once a tablet has been designated for a particular drug cell, the diameter and width being known, it is only necessary to go to a chart such as Table I to determine the proper disk, take the disk out of inventory, place it in the cell and the apparatus is accommodated to the new pill.

Referring to FIG. 1, the counting control means 18 is connected to the article holding means 16 by wiring 60. The counting means 18 is preferably housed within a separate unit, as shown, so that this control may be connected in parallel with and control a plurality of the article holding means 16.

The counting control means 18 may be conventional. A commercially available counting unit which we have found satisfactory is manufactured by the Standard Instrument Corporation Division of Automatic Timing & Controls, Inc., King of Prussia, Penn., 7301 Series transistorized predetermining counter. Also satisfactory are certain commercially available electro-mechanical predetermining counters. Similarly the counting control disclosed by U.S. Pat. No. 3,368,713, issued to us on Feb. 13, 1968 may be used, however, we have found that if the control circuit disclosed in that patent employs the above named counter or its predecessor model, the circuit is preferably modified slightly to obtain a more accurate count.

Figure 8:
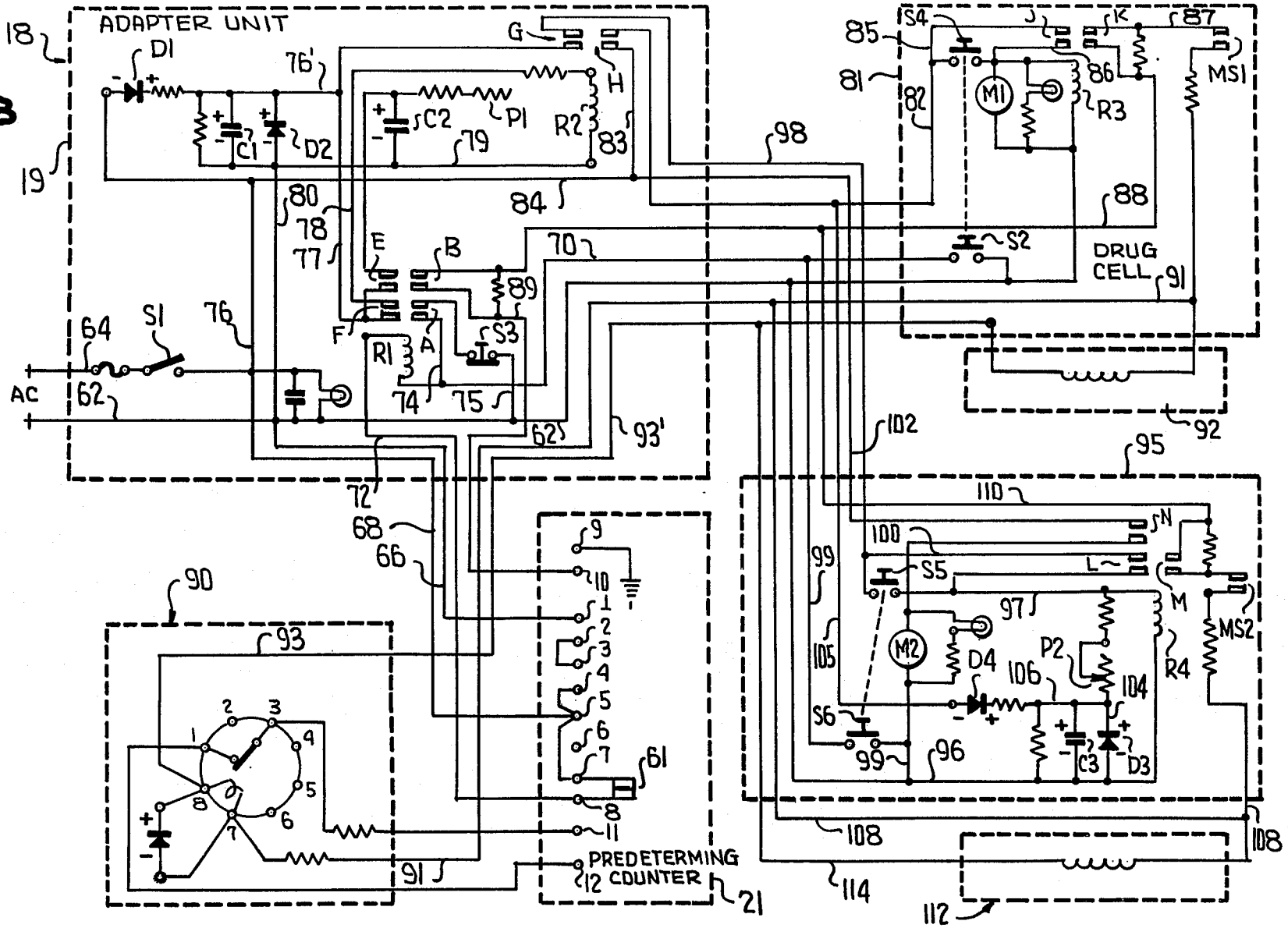
FIG. 8 is a schematic circuit diagram of one embodiment of the master control and drug cell circuits.

Referring more particularly to FIG. 8, an electrical circuit is disclosed which is preferably partially housed within the box-like holding means 16 and partially housed within the counting control unit 18 (FIG. 1). Unit 18 contains the following circuit elements: shield lines 19 (adapter circuits), shield lines 90 (mercury wetted relay), and the shield lines 21 containing terminal posts numbered 1 through 12. Certain wires of the electrical circuit are connected to the terminal posts 1 through 12 as hereinafter described. The 7301 Series counter includes a pair of normally closed contacts 61 which open when a predetermined count has been reached to interrupt the electrical circuit as hereinafter described.

The components of FIG. 8 are shown in de-energized position. Alternating current AC, connected with a source of electrical energy, not shown, supplies current to the circuits by wires 62 and 64 through an "off-on" control switch S1. The current source wires 62 and 64 are connected by wires 66 and 68 to terminal posts 1 and 5, respectively. The post 5 is bridged with post 7 to supply current to the contacts 61. A continuation of the current source wire 62 is connected to one terminal of the motor M1. A wire 70, connected with the wire 62 through a normally open start switch S2, is connected with one terminal of a relay R1 having four pairs of contacts or points A, B, E and F. The other terminal of relay R1 is connected by a wire 72 to post 8. Thus, closing switch S2 completes a circuit from the current source through the closed contacts 61 to energize the coil of relay R1 to close its respective contacts A, B, E and F. Contacts A of relay R1 are holding contacts, one being connected to the wire 70 by wire 74 and the other connected to the wire 62 by a wire 75 through a normally closed stop switch S3. Thus, when the starting switch S2 is released the holding contacts A maintain relay R1 energized. The wire 64 is connected to one terminal of a direct current relay R2, having contacts G and H, by wires 76, 76', 77 and 78, through a rectifier or diode D1, suitable resistors and the contacts F of relay R1. The lowermost contacts of E and F of relay R1, as viewed in FIG. 8, are connected together. The other terminal of relay R2 is connected by wires 79 and 80 to the other current source wire 62. A suitable resistor, condenser C1 and second diode D2 are connected in parallel between the wires 76' and 79. One of the contacts E of relay R1 is connected to the wire 78 through a potentiometer P1. A condenser C2 is connected across the wires 78 and 79 to discharge through the potentiometer P1 and relay R2 for the reasons presently explained. Thus, when relay R1 closes its contacts F, direct current is applied to relay R2 to close and energize its contacts G and H.

The other terminal of the motor M1 is connected through a switch S4, ganged with and operated by the switch S2, to one of the contacts H of relay R2 by a wire 82. The other contact of the contacts H is connected to the wire 76 by wires 83 and 84.

A third relay R3, having contacts J and K, has one of its terminals connected with the source wire 62 and its other terminal connected with the switch S4 in parallel with the motor M1. The contacts J of relay R3 are connected respectively to the terminals of the switch S4 by wires 84 and 86. Thus, when switch S4 is closed the motor M1 starts and relay R2 is energized which maintains the motor M1 energized through the contacts H of relay R2 and contacts J of relay R3. One of the contacts K of the relay R3 is connected by a wire 87 to one contact of the microswitch MS1. The other contact K of relay R3 is connected by a wire 88 to one of the contacts B of relay R1. The other contact B of relay R1 is connected by a wire 89 to a source of direct current voltage (post 10). The other terminal of the microswitch MS1 is connected to one terminal of the mercury wetted relay (shield lines 90) by a wire 91. The other terminal of the mercury wetted relay is connected by a wire 93 to ground post 9 of the transistorized counter. The mercury wetted relay is also connected with posts 11 and 12. The purpose of the mercury wetted relay is to prevent any inaccurate counts of the transistorized counter as a result of rapid making and breaking of the contacts of the microswitch MS1 as a result of tablet or capsule movement closing these contacts more than one time by spasmodic contact of the tablet or capsule with the microswitch arm 54 during the time that the tablet or capsule passes over the microswitch and leaves its respective slot to fall into the opening 44. The mercury wetted relay has the characteristic of maintaining contact when its circuit is closed which holds until the circuit is positively interrupted. A digital counter, enclosed by the shield lines 92, for visual indication of the tablet or capsule count as it progresses, is connected to the lowermost contact of microswitch MS1, as viewed in FIG. 8, and to ground post 9 by a wire 93'.

In operation of the described embodiment, with the "off-on" switch S1 closed, the starting switch S2 is depressed, which also closes switch S4, for energizing relay R1 as described hereinabove. This also energizes and continues operation of the motor M1 thus rotating the selected tablet or capsule hopper 26 or 26'. As the articles being counted approach the housing opening 44, they successively contact the microswitch arm 54 and close the contacts of microswitch MS1 which energizes the counter unit through the mercury wetted relay. When the pre-set count has been reached, the normally closed contacts 61 of the counter are opened interrupting the current to the coil of relay R1 to open its contacts A, B, E and F and de-energize the motor M1 which stops the counting operation. However, it is necessary that the motor M1 continue the angular rotation of the hopper a sufficient distance to insure that the last tablet or capsule counted moves beyond the microswitch arm 54 so that the tablet or capsule will fall through the opening 44. This is accomplished by the time delay setting of potentiometer P1 which relays de-energizing relay R2. When relay R1 is initially energized, current through its contacts F is applied to relay R2 from the diode D1 and through the contacts E of relay R1 to capacitor C2; this allows relay R2 to energize immediately and capacitor C2 to charge immediately. Without these two sources of current either relay R2 would not energize firmly or capacitor C2 would delay charging fully.

As explained hereinabove, when the count is completed relay R1 is immediately de-energized opening its contacts E and F which would normally de-energize relay R2 immediately but as this occurs capacitor C2 discharges through potentiometer P1 and associated resistors and the coil of relay R2 to form a time delay and maintain relay R2 energized for a predetermined period of time selectively adjusted by the setting of potentiometer P1 from a zero time setting to several seconds duration. This permits relay R3 to remain energized an equal time after the completion of a count so that the motor M1 continues rotation and movement of the hopper so that the last article counted by closing of the microswitch MS1 will fall by gravity through the drop-out hole 44 but stopping hopper rotation before a next or succeeding tablet or capsule will be counted. Without the time delay feature provided by capacitor C2 the rapid action of the count cut-off and a brake, not shown, on the motor M1, would stop the last article counted in contact with the microswitch arm 54 resulting in an under count of one article. The function of diode D2 is to provide a constant value direct current voltage from the current source wires 62 and 64. This constant or regulated direct current voltage allows the time lapse or delay set by potentiometer P1 to remain the same each time the counting operation stops to insure a constant time delay movement of angular rotation of the hopper.

We have found that it is sometimes desirable to provide additional time delay for the counter operation in addition to the time delay of potentiometer P1 due to the different operating characteristics of the selecting means 16 and the articles being counted. In this event an additional time delay circuit is provided which is controlled by a second potentiometer P2 which adds to the time delay provided by potentiometer P1. The circuit adding potentiometer P2 to the counting circuit is shown within the shield lines 95, and is similarly in function to the circuit connecting the motor M1 with the microswitch MS1 shown within the shield lines 81 and is connected to the counting circuit in a somewhat similar manner.

A wire 96 is connected to the current source wire 62 and is connected to one terminal of a direct current relay R4 having three pairs of contacts L, M and N. The other terminal of relay R4 is connected by wires 97 and 98 through the contacts L to one of the contacts G of relay R2. The other one of the contacts G of relay R2 is connected to the wire 76'. A starting switch S5 is connected across the wires 97 and 98 in parallel with the relay R4 contacts L. The starting switch S5 is ganged with a starting switch S6 interposed in a wire 99 connected at one end with the wire 96 and connected at its other end to the wire 70.

A motor M2 has one of its contacts connected with the wire 99 between the switch S6 and wire 96 and its other terminal connected to one of the contacts N of relay R4 by a wire 100. The other contact N is connected to the wire 84 by a wire 102. The potentiometer P2 is connected in series with a resistor and diode D3 between the wires 96 and 97 in parallel with the relay R4. A wire 105, connected with the wire 82 between relay R2 contacts H and starting switch S4, is connected to the wire 104 in series through a diode D4 and a resistor between the diode D3 and potentiometer P2 by a wire 106. A capacitor C3 and suitable resistor are connected across the wires 96 and 106 in parallel with the diode D3. The contacts H of relay R2 apply AC voltage to diode D4 and, therefore, direct current to relay R4. Thus, diodes D3 and D4 apply direct current voltage from two different sources to relay R4 and capacitor C3 which insures direct current regulation and permits immediate energization of relay R4 and allows capacitor C3 to immediately charge. A wire 108 is connected at one end with the wire 91 and connected at its other end to one terminal of a second microswitch MS2 through a suitable resistor. The other terminal of the microswitch is connected to one contact M of the relay R4. The other contact M is connected to the wire 88 by a wire 110. Similarly, a digital counter, indicated by the shield lines 112, is connected to the wire 108 and to the wire 93 by a wire 114.

As stated hereinabove the motor M2, the microswitch MS2 and ganged starting switches S5 and S6 correspond in their function to motor M1, microswitch MS1 and ganged starting switches S3 and S4.

The operation of the circuit and components within the shield lines 95 is similar to that described hereinabove for the circuit and components within the shield lines 81 except that to achieve additional time delay, relay R4 must remain energized for a time after relay R2 is de-energized. When relay R2 is de-energized both of its pairs of contacts G and H open. When the contacts G and H open direct current voltage from relay R2 is removed from relay R4. This permits the capacitor C3 to discharge through potentiometer P2 to maintain relay R4 energized insuring motor M2 of AC voltage through contacts N of relay R4 as long as relay R4 remains energized.

The circuit of FIG. 8 is satisfactory for small operations where not many drug cells are employed. However in large installations where as many as 48 or 96 drug cells may be controlled by a single control, the circuit of FIG. 8 may not provide all of the necessary safeguards. For instance, when one drug cell is in operation a second cell can also be placed in operation. As a result, the counter responds to operation of the M5 switches in two cells concurrently with a resulting inaccurate count in both cells. A second problem may arise if switch 52 contacts close but the contacts 54 do not close or are not closed for a sufficiently long time for relay R3 to hold. The system will be primed but the cell will not operate and if the start switch of a second cell is depressed the cell may operate but without the proper count inserted.

The above conditions should not produce problems in a small operation where the control unit is a part of or located quite close to the drug cell since the operating conditions of all of the drug cell or cells are easily detected when standing in front of the device. In large operations however the operator may be quite a distance (4 to 6 feet) from other drug cells so that their operation might not be detected particularly where several individuals are using the system.

The problems described above are overcome by use of the circuit of FIG. 9 which circuit provides other desirable features.

Figure 9:
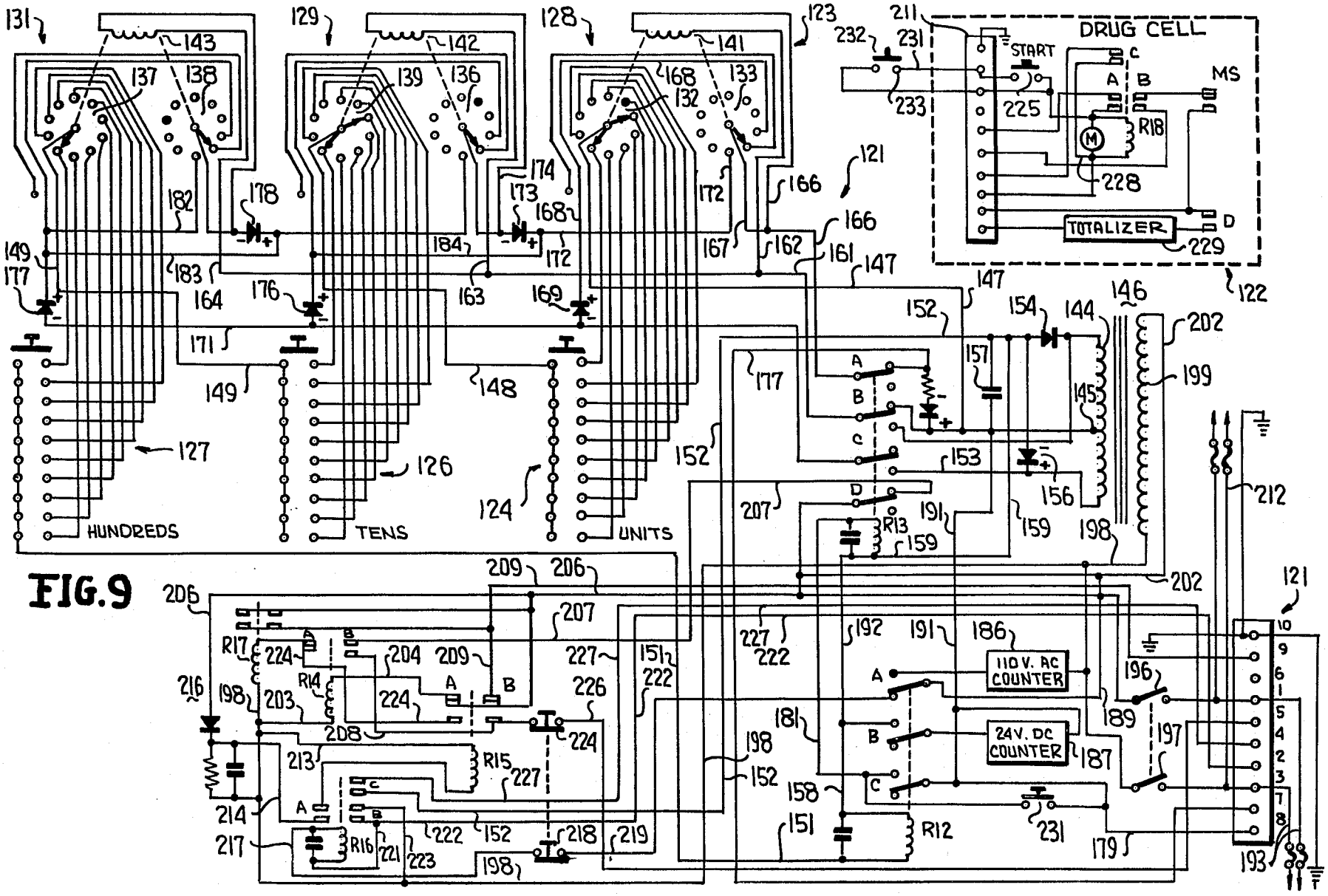
FIG. 9 is a schematic circuit diagram of a preferred form of master control and drug cell circuits.

Referring specifically to FIG. 9 of the accompanying drawings there is illustrated a master control unit generally designated by the reference 121 and a drug cell generally designated by the reference numeral 122. In actuality there are a large plurality of the drug cells 122 but since the circuitry and operation of all of them is identical, only one is illustrated. Included in the master unit 121 is a master counter generally designated by the reference numeral 123. The unit 123 includes three push-button selectors, a units selector 124, a tens selector 126 and a hundreds selector 127. Associated with each of the push button selectors of the master counter are three counters designated by the reference numerals 128, 129 and 131 respectively. Each of the counters includes two rotary switches 132 and 133 associated with the stage 128, 134, 136 associated with the stage 129 and 137 and 138 associated with the stage 131. The counter sections 132, 134 and 137 are employed to complete a circuit through the push button mechanisms 124, 126 and 127 when the count selected by the actuation of the push buttom has been achieved and to provide a signal indicating such event. The counter stages 133, 136 and 138 are employed to produce energization of the next counter stage of higher order upon the lower order stage completing one complete revolution of its rotary section. The rotary switches are stepped by counter coils 141, 142 and 143, respectively.

Referring now to the operation of the push buttons in conjunction with the rotary switches 132, 134 and 137, the center tap 145 of a secondary winding 144 of a power transformer 146 is connected via lead 147 to the rotating contact of the switch section 132. The stationary contacts 0 through 9 of the section 132 are connected to 0 through 9 contacts, respectively, of the push button unit 124, these contacts being shown on the right side of the switch section 124 and arranged in a vertical row commencing at the upper end with numeral 0. The left set of contacts of the section 124 are connected together and via a lead 148 to the rotating contact of the switch section 134. The stationary contacts 0–9 of the rotary switch section 134 are connected, respectively, to the contacts 0–9 of the push button switch section 126, these being the right contacts as viewed in FIG. 9 and commence with the contact 0 as the uppermost contact. The left contacts of the push button switch section 126 are connected together and via a lead 149 to the rotary contact of the switch section 137. The stationary contacts of the switch section 137 are connected as previously indicated relative to the prior two switch sections to the right stationary contacts as viewed in FIG. 9 of the push button switch section 127. The left contacts of the switch section 127 are connected together and to a lead 151.

When a preselected count is inserted in the counter, certain of the right-hand stationary contacts of the push button units are connected via the bridging contact of the push button to the rest of the contacts of the bush button switch sections. When the rotary contacts of the switch sections 132, 134 and 137 engage contacts connected to the push button contacts which are bridged to the left set of contacts, a circuit is completed from the center tap of the secondary winding 144 of the power transformer 146 via lead 147, rotary switch section 132, push button section 124, rotary switch 134, push button contacts 126, rotary switch section 137 and push button contacts 127 to apply a voltage on the lead 151 for purposes to be described subsequently.

The center tap of the winding 144 has developed thereon a dc voltage which is positive relative to a voltage appearing on a lead 152 of a power supply and which is negative relative to the voltage appearing on the lead 153 of the power supply. The power supply comprises a pair of diodes 154 and 156 connected between the upper and lower terminals of winding 114 and leads 152 and 153, respectively, and capacitors 157.

The lead 151 is connected to the lower terminal of a relay R12, the other terminal of which is connected via a lead 158 and a lead 159 to the lead 152 from the power supply. Thus, when the circuit is closed from the center tap of the transformer secondary to the lead 151, the relay R12 is placed across the center tap of the transformer and the lead 152 so as to be energized for purposes to be described subsequently but which are obviously related to terminating count and operation of the unit since the predetermined count has been achieved.

Referring again to the master counter, the operation of the solenoids and their associated coils 141, 142 and 143 is now described. The center tap of the transformer 146 is connected through normally closed contacts "B" of a relay R13 to a lead 161. The lead 161 is connected via leads 162, 163, and 164 to the right terminal of the coils 141, 142 and 143 respectively. The left terminal of the coil 141 is connected to a lead 166 on which, as will be described subsequently, is developed counting pulses. The lead 166 is further connected via a lead 167 to the rotary contact of the rotary switch section 133. The 0 contact of the switch section is unconnected. The contacts 1–8 are connected together and via a lead 168 and a diode 169 connected in series to a voltage bus 171 for purposes to be described subsequently. The ninth contact of the rotary switch section 133 is connected via a lead 172 through a diode 173 to a lead 174 connected to the left terminal of the counter coil 142.

The internal connections of additional rotary switch sections 136 and 138 are the same as the section 133 with the 1–8 terminals being returned to the bus 171 via diodes 176 and 177, respectively. The ninth contact of the section 136 is connected through a diode 178 to the left terminal of the coil 143 and the ninth contact of the section 138 is connected via the aforesaid diode 177 to the voltage bus 171. The voltage bus 171 is returned through normally open contact "C" of the relay 13 to the lead 153. The lead 166 is connected through the normally closed contacts "A" of the relay 13 to a lead 177 on which counting pulses are developed.

When the rotary switch sections are in the 0 condition, a counting pulse appearing on the lead 166 causes the section 133 to be stepped. When the coil 41 has received nine counts, the rotary contact engages the stationary contact 9 and applies voltage to the lead 172. The counting pulses on the lead 166 are negative or more precisely when a voltage is applied to the lead 166 it is negative relative to the voltage appearing at the center tap 145 of the transformer secondary 144. Thus a negative voltage is applied to the lead 172 and the diode 173 is rendered conductive so that when the next counting pulse is applied, both the coils 141 and 142 are energized. Movement of the rotary contact of the switch section 133 due to the receipt of this most recent pulse, causes the rotary contact to engage the 0 contact and voltage is removed from the lead 172. Thus the tens counter coil 142 does not receive its next counting pulse until the rotary contact of the switch section 133 has been stepped through ten additional pulses at which time the tens counter is again energized. The corresponding operation is achieved with the coil 143; that is, the coil 143 is energized every time ten counts have been received by the coil 142 and thus the counter section 131 counts by hundreds. The diodes 169 and 176 and 177 are utilized to reset the counter after a desired count has been achieved and the machine has stopped operation. Specifically, when the desired count has been received, the relay R12 is energized and closes its contacts including its "C" contact. Voltage appearing on a lead 179 is applied via a lead 181 to the upper terminal of relay R13 and all of its contacts are switched to position opposite that illustrated in FIG. 9. Counting voltage is removed from the lead 166, and the voltage appearing on the lead 153 is applied to the lead 171 and the lead 161 maintains its connection to the center tap of the secondary 144 of the transformer 146. On each positive half cycle of the alternating current appearing across the secondary 144, the diodes 169, 176 and 177 are rendered conductive and apply a succession of positive pulses to the terminals 1–8 of each of the switch sections 133, 136 and 138. If the rotary contact is in contact with any of these sections, the alternating current pulses are applied to the left terminal of each of the coils 141, 142 and 143. Since the right-hand terminal of each of the coils is now connected to the upper terminal of the secondary 144, the switch sections 133, 136 and 138 are rotated in the same direction that they are normally rotated until the zero contact is reached. The zero contacts are unconnected and therefore the switches proceed no further. If any of the rotary contacts of the switch sections 133, 136 or 138 are in engagement with the ninth terminal of the rotary switch, the pulses are applied to the ninth contact of the section 136 via a lead 183 so that the same operation ensues as if the rotary contact were in engagement with the contacts 1–8. The ninth contact of the section 133 is connected via lead 172 and thence lead 184 to the upper end of diode 176 so that positive half-cycles are applied to the contact 9. Thus, upon the counter achieving the preset count as determined by the push button switches 124, 126 and 127, the counter is automatically reset through operation of the relays R12 and R13.

The derivation of the voltage on the lead 179 which is necessary to the operation of the relay R13 is described subsequently. Briefly, the master unit is provided with a 110 volt a.c. counter 186 or alternatively a 24 volt d.c. counter 187. Upon the relay R12 becoming energized, which occurs at the end of each dispensing cycle, its contacts A and B are closed. The closure of the contact A places the counter 186 across leads 188 and 189 to which alternating current is applied. The counter counts only once for each such closure and is employed to indicate the number of times drugs have been dispensed from the entire unit. The counter 187 upon closure of the contacts B of the relay R12 is placed across dc leads 191, connected to the center tap 145 of the secondary 144 of the transformer 146, and through the contacts B to a lead 192 which is connected to the lead 152 of the dc source. As indicated above, both counters are not provided in a single unit but are employed alternatively.

The operation of the master control unit in conjunction with the drug cell is now described. Alternating current from a suitable source is derived on a pair of leads 193 and connected to terminals 1 and 3 respectively of a terminal block 194 forming an integral part of the master unit. Ground is applied to terminal 10 of this block. The alternating current terminals 1 and 3 are connected via an on/off switch having contacts 196 and 197 to leads 189 and 188, respectively. The lead 188 is connected to a lead 198 which in turn is connected at one end to the lower terminal of primary winding 199 of the transformer 146. The upper contact 196 of the on/off switch is connected to a lead 202 connected to the upper terminal of the primary winding 199. Thus, upon closure of the on/off switch contacts 196 and 197, the transformer 146 is energized.

The lead 198 is connected to the lower terminal of the coil of relay R17 and via a further lead 203 to the lower terminal of the coil of relay R14. The upper terminal of the relay coil R14 is connected via a lead 204 to normally closed contacts A of relay R15. The movable contact of the contacts A of relay R15 is connected to the movable contact of a set of contacts B of the same relay and thence via a lead 206 to and through the on/off contacts 196 to the ac terminal 1. As previously indicated, the lead 198 is connected through the on/off contacts 197 to the other ac terminal 3. Thus, upon closure of the on/off switch the relay R14 is energized, opening its contacts A and closing its contacts B.

The upper contact B of relay R14 is connected via a lead 207 and through contacts D of the relay R13 to the ac terminal 1. The lower contact B of the relay R14 is connected via a lead 208 to the lower contact of the contacts B of the relay R14 for purposes to be described subsequently. The relay R15 is not energized at this time and its uppermost contact of the set of contacts B is connected via the lead 209 to terminal 9 of the terminal block 194. The movable contact of the set of contacts B of the relay R15 is, as previously indicated, connected via the lead 206 to one side of the ac line. Thus, upon operation of the on/off switch 196–197, alternating current appearing on the terminal 1 is connected to the terminal 9 which is in turn connected to the terminal 9 of terminal block 211 of each of the drug cells, only one of which, designated by reference numeral 122 is illustrated. Terminal 3 of the terminal block 211 is connected directly via a lead 212 to the terminal 3 of the master unit and thus bypasses the on/off switch.

The upper end of the coil of the relay R15 is connected via the lead 213 to the ac lead 198 and the lower end of the coil is connected to an upper contact of contacts A of a relay R16. The lower contact A of the relay R16 is connected via a lead 214 to a half-wave rectifier supply 216 connected between the lead 198 and the lead 206 which, as previously indicated, is connected to the ac terminal 1 of the terminal block 194. Thus opon closure of the contacts A of the relay R16 the relay R15 is energized.

The relay R16 has the upper terminal of its coil connected via a lead 217, through stop switch 218, via lead 219 and through the lower contacts A of the relay R12 to the lead 189 connected to the terminal 1 of the terminal block 194. The lower end of the coil of relay R16 is connected via a lead 221 to a lead 222 and to a lower contact of a set of contacts B of the relay R16; the contacts B being the holding contacts of the relay. The upper contacts B of relay R16 is connected via the lead 223 to the ac lead 198. The lead 222 is connected to terminal 2 of the terminal block 194 and therefore to the terminal 2 of the contact block 211 of the drug cell 122.

The relay R17 has the lower end of its coil connected to the lead 198 and the upper end of its coil connected to the upper contact of the A contacts of the relay R14. The lower of the A contacts of relay R14 is connected via a lead 224 to a lower stationary contact A of the relay R15. The lower stationary contact of the B contacts of the relay R15 is connected through a second stop switch 224 which is ganged with the switch 218 and via a lead 226 to the terminal 5 of the contact block 194 and thence to terminal 5 of the contact block 211 of the drug cell 122.

The relay R16 has a further set of contacts C, the lowermost of which is connected to the lead 152 and the uppermost of which is connected via a lead 227 to contact 4 on the terminal block 194 which in turn is connected to contact 4 on the terminal block 211 of the drug cells.

Referring now to the drug cell, each of the drug cells comprises a motor 228 in parallel with the coil of a relay R18 having sets of contacts A, B, C and D. Upper contact A is connected to the terminal 5 of the block 211 and lower contact A is connected to the upper end of the motor and relay coil. Lower contact B is connected to terminal 4 of block 211 and the upper contact B is connected to an upper contact of switch MS. Upper contact C is connected to terminal 2 of the terminal block 211 and lower contact C is connected to the lower end of the motor and relay coil. The lower contact of the switch MS is connected to the terminal 7 and to the upper contacts D of the relay R18. Lower of contacts D of the relay R18 is connected through a counter or totalizer 229 to terminal 8 of the terminal block 211.

In operation, upon closure of the switches 196 and 197, the relay R14 is energized. Upon closing of contacts B of relay R14 one side of the alternating line, which is connected to the terminal 1 of the terminal block 194, is connected to the terminal 5 of the terminal blocks 194 and 211. The alternating voltage of the terminal 1 is also applied to the terminal 9 of the terminal blocks 194 and 211 and to the B contacts of the relay R15 which is de-energized at this time. Upon depression of a start switch 225 of the drug cell 122, the motor 228 and relay R18 are energized, being connected through the switch to terminal 9 and to the other side of the ac line at the terminal 3 of the block 211.

When the relay R18 is energized, it closes its A contacts to connect the upper terminals of the motor 228 and relay R18 to the terminal 5, which is connected to one side of the ac line through the contacts B of the relay R14, thereby setting up a holding circuit for the relay and motor. Upon closure of the contacts B of the relay R18, the counter microswitch MS is inserted in the circuit and the totalizer 229 is connected through now closed contact D of the relay R18 to the terminal 8 connected via leads 179 and 191 to the center tap 145 on the secondary winding 144 on the transformer 146. Closure of the contacts C of the relay R18 connects the terminal 2 of terminal block 211 to the ac terminal 3. The terminal 2 of contact block 211 is connected (plugged into) to terminal 2 of terminal block 194, this latter terminal being connected via lead 222 to the lower end of the coil of relay R16 whereby this latter relay is energized.

Upon energization of the relay R16, it closes all three sets of its contacts, the contact A, upon closing, producing energization of the relay R15, the contact B constituting holding contacts for the relay R16 and the contacts C applying a voltage to the terminal 4 of the terminal block 194 and the terminal block 211. The terminal 4 of the block 211 is connected to the lower contact B of the relay R18 and applies a voltage appearing on the lead 152 to the contacts of the switch MS so that one side of the dc line is applied to the terminal 7 when the contacts of the switch MS are closed. It will be remembered that the terminal 7 of the contact block 194 is connected via the lead 166 to the master counters so that when the contacts of the switch MS are closed, the negative side of the dc power supply is intermittently connected to the coils 141, 142, 143, of the counter, the other sides of the coils being permanently connected to the center tap 145 of the transformer secondary 144 through the contact B of the relay R13. Energization of the relay R15 de-energizes the relay R14 by reason of opening of the upper contacts A, while closing the lower contacts A energizes the relay R17 through the now closed contacts A of the relay R14. Opening of the upper contacts B of the relay R15 removes voltage from the terminal 9 of the block 194 and thus the terminal 9 of all of the drug cell blocks 211. As a result, no other drug cell can be energized once this voltage has been removed.

It will be noted that the contacts A of the relay R17 are in parallel with the upper contacts B of the relay R15. The reason for this is to introduce a time delay between the interval when the relay R15 is actuated and the voltage is removed from the terminal 9. It is possible, that the relay R15 might drop out before the holding contacts A of the relay R18 have fully engaged and thus, although the start switch 225 of a drug cell has been depressed and the relay R15 actuated, the drug cell will not be actuated. By paralleling the contacts A of the relay R17 with the upper contacts B of the relay R15, removal of the voltage on the terminal 9 is slightly delayed and insures that the relay R18 has caused its contacts A to fully engage to establish the holding circuit before voltage on terminal 9 is removed.

Reference is again made to the start switch 225 in the drug cell. It is essential to proper operation of the system that the relay R16 is energized whenever relay R18 is energized and vice versa. If the circuit does not provide this feature two problems can arise. If the relay R16 is energized and the relay R18 is not, then the central control locks out all drug cells since voltage is removed from terminal 9 and the system must be recycled by depressing reset switch 231 to be described subsequently before operation can be resumed. The above condition can occur if voltage is applied to terminal 2 of the drug cell and the relay R18 fails to pick up. On the other hand problems arise if the relay R18 is energized and the relay R16 is not. Under these conditions the motor of the drug cell is running and causes pills to be dispensed but no counting occurs and pills are continually dispensed until pills fill up the dispensing tank and back up into the region of the disk where they will be ground up.

In order to obviate both of the above problems the contacts C are added to relay R18. The contacts C and A are closed concurrently so that voltage is applied to terminal 2 only when the holding circuit of the relay R18 has been closed through contacts A.

It is apparent from the above that the circuit of the present invention overcomes the difficulties encountered in the circuit of FIG. 8 in that a cell either acquires control of the system or no cell does and further, continuous running of the drug cell cannot result due to improper starting.

When the counter has counted to the predetermined count set into the system by the push button, the relay R12 is actuated, closing its contacts B and C and closing contacts A to the upper contact. As previously indicated, only one of the sets of contacts A or B will be connected to a counter depending upon whether an ac or dc counter is employed. In any event, when the relay R12 is energized, one of the counters makes a count indicating that an operation of a drug cell has occurred. Closure of the contact C energizes the relay R13 opening the counting circuit to the coils 141, 142 and 143 through contact A. Contacts B and C of relay R13 are closed to their lower contacts so that the reset cycle of the counters is initiated; that is, all the counters are reset to zero. The contacts D of relay R13 are opened so that a voltage is not applied to the contacts B of the relay R14 during the reset cycle.

It should be noted that when the movable contact of contacts A of the relay R12 is closed to its upper contact, voltage is removed from the relay R16 so that the relays R14, R15 and R17 revert to their previous condition with the contacts B of the relay R14 closed. During this interval the hold voltage applied to the contacts A of the relay R18 is removed from the terminal 5 due to the lower contacts B of the relay R15 opening so that the drug cell circuit drops out.

The apparatus, as previously indicated, is provided with stop switches 218 and 224 which are ganged together and when depressed, de-energize the relay R16 and remove voltage from the terminal 5 of the drug cell producing the same operation as if the relay R12 were actuated. The apparatus is also provided with a reset switch 231 as previously indicated. This switch bypasses the relay R12 so that the circuit relays R14, R15, R16 and R17 are undisturbed by operation of this switch. However the relay R13 is actuated and produces immediate reset of the master counters, at the same time removing voltage from the terminal 7 so that the microswitch MS cannot send count pulses to the counter during this interval. Contact D of the relay R13 removes voltage from the upper contact B of the relay R14 but since this relay is not actuated at this time, it has no effect on the circuit. Normally, the reset button is employed when the circuits of the relays R14–17 have been actuated and a false count has been obtained for any reason. The reset insures that the counter is clear so that when the start button is again pushed in a selected drug cell, a count commences with zero count in the master counter.

If desired the complete set of drug cells may be controlled from a single remote control station which would normally include the master control unit. Such a station could be established at the drug counter and would permit the pharmacist to operate the equipment without having to leave the counter.

In order to provide remote control of the individual drug cells, a lead 230 is connected to the pin 9 of the terminal block 211 of one of the drug cells and is extended to the remote control station where it is connected to one terminal of each of a plurality of remote control drug cell switches 232, only one of which is illustrated in FIG. 9. Since the pin 9 initially carries energizing voltage to the drug cells, such voltage is applied to one terminal of all of the remote control switches 232. A second terminal 233 of each switch 232 is connected to pin 6 of a different one of the terminal blocks 211, each associated with a different drug cell. Pin 6 is connected via a lead 234, the upper terminal, as illustrated in FIG. 9, of disk driving motor 228.

In consequence the pharmacist may turn on the master control, select the number of pills to be dispensed and actuate the drug cell containing the desired drug all without leaving the drug counter or other appropriate location.

Referring for a moment to the disk of FIG. 2, as was previously indicated, the 10° reverse angle of the outer section 38 of the slots is employed to clear jams which occur when two tablets attempt to enter a slot at the same time. It has been found that the jams which occur when two tablets enter a slot, were due to unseating of the disk from the platform 24 due to wobble of the disk relative to that platform. When two tablets attempt to enter the regions 38 at the same time and there is a small gap between the bottom of the disk 32 and the platform 24, one of these tablets may become wedged into this space creating the jam which then requires the 10° reverse angle on the slot to clear it due to reverse drag on the tablet, particularly the wedged tablet.

Figure 12:
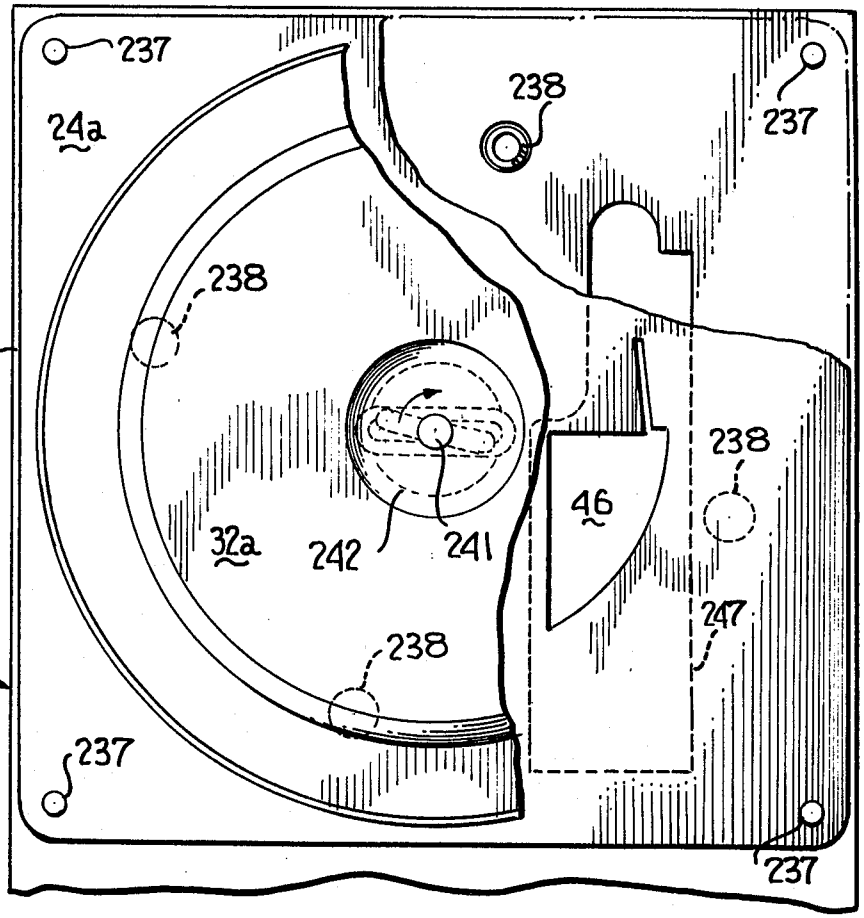
FIG. 12 is a top view of the arrangement of FIG. 11.
Figure 13:
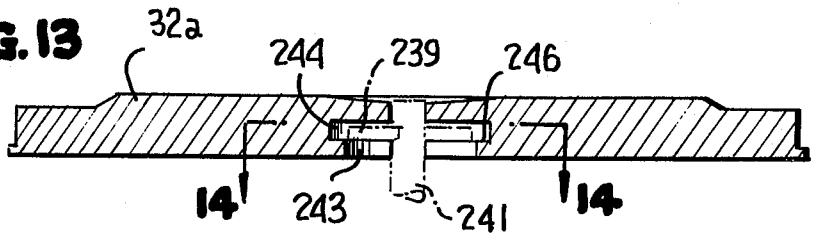
FIG. 13 is a side view in section of a capsule and tablet disk for use with the hopper supporting platform of FIG. 11.
Figure 11:
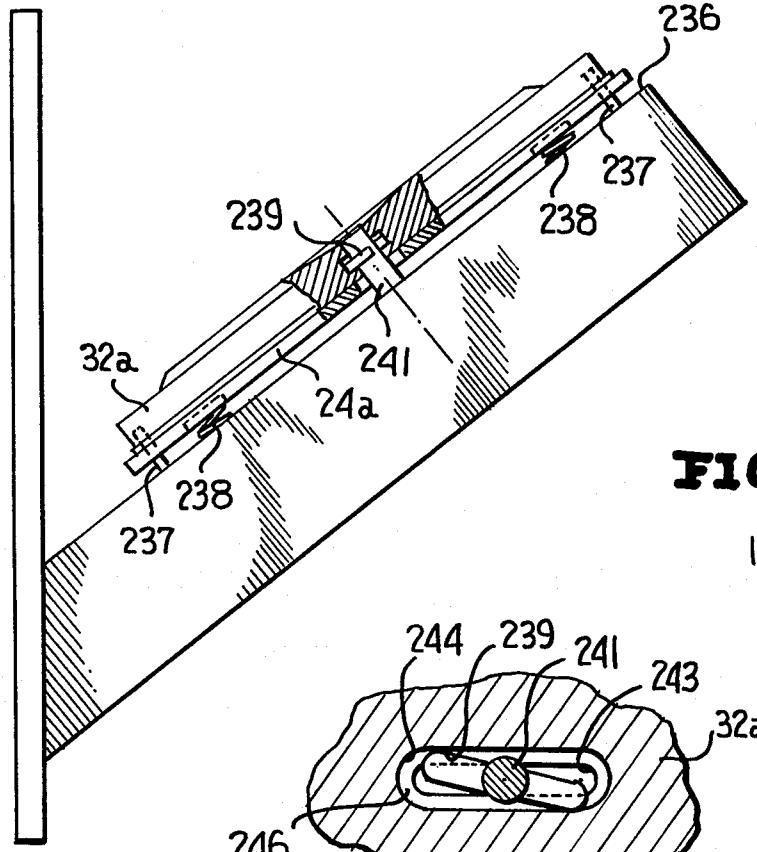
FIG. 11 is a side view in elevation of a preferred embodiment of the hopper supporting platform.

It has been found that this problem can be virtually eliminated by utilizing an arrangement where the platform 24 is spring biased against the bottom of the disk. Reference is now made specifically to FIGS. 11–13 for illustrations of this arrangement. In this arrangement an upper surface 236 of article holding means 16 is provided with four upstanding metal pins 237, only two of which are illustrated in FIG. 11 and a platform or flat relatively rectangular plate designated 24a is provided with four holes arranged so that the pins 237 pass through the holes in the member 24a. The plate 24a is positioned above the dispensing means 16. There are provided four coiled compression springs 238, again only two of which are illustrated in FIG. 11, which bias the platform 24a above the upper fixed surface of the article holding means 16. A disk 32a is disposed above the platform 24a and is locked into position against the platform 24a by a key 239 secured to the end of shaft 241 of the drive motor.

When a drug hopper is to be fitted to the apparatus and only the disk 32a of the hopper is illustrated in FIG. 11, the hopper is positioned such that the key 239 passes through an appropriately shaped slot in the bottom of the disk 32a and the disk is pressed against the platform 24a and then rotated so as to lock the disk on the key. The springs 238 bias the platform 24a against the bottom of the disk 32a and assure intimate contact between the two so that small air spaces or gaps do not exist between these two numbers. Other equally appropriate locking means for the disk 32a may be used.

Figure 14:
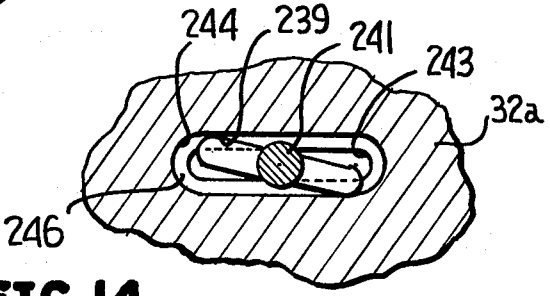
FIG. 14 is a section taken along line 14—14 of FIG. 13.

Referring now specifically to FIGS. 12 through 14, the inter-relationship of the disk, platform and article holding means are illustrated in greater detail. The shaft 241 of the drive motor with the key 239 secured to the end thereof passes through an enlarged opening 242 in the upper surface 236 of the article holding means 16 and a corresponding aperture which does not bear a reference numeral in the platform 24a. The bottom of the disk is provided with a slot 243 which is slightly larger and of the same configuration as the key 239. Interiorly of the disk 32a, and reference is made specifically to FIGS. 13 and 14, and coaxial with the shaft 241 is an enlarged region 244 which permits the disk to be rotated relative to the key 239 so that the key engages a surface 246 interiorly of the disk which is not aligned with the key way 243 formed in the bottom thereof. Therefore the key 239 engages shoulder 246 of the disk and holds the disk 32a down against the platfrom 24a to insure intimate contact therebetween which does not permit air spaces between the two members.

The dashed line 247 of FIG. 12 illustrates a drop out shoot for the tablets or capsules in the surface 236 of the article holding means 16.

Figure 15:
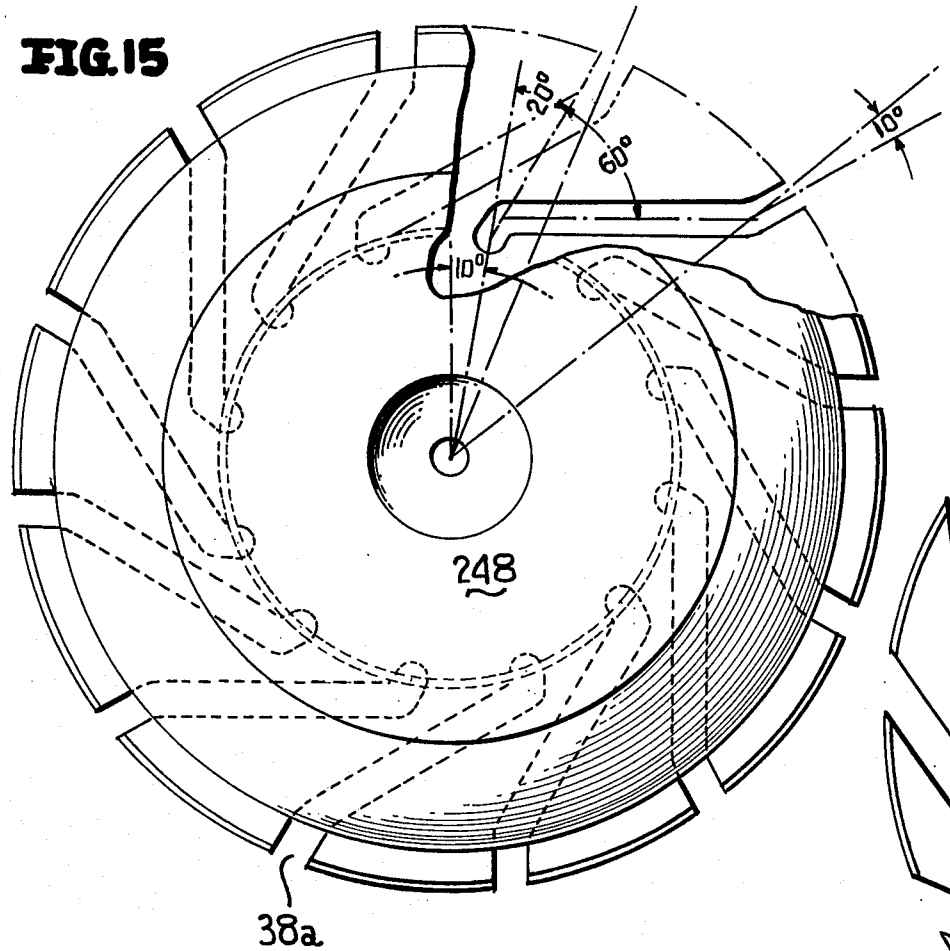
FIG. 15 is a preferred embodiment of a tablet dispensing disk and constitutes a modification of the disk of FIG. 2.

As a result of the arrangement of the apparatus of FIGS. 11 and 12, the disk 32 may be modified to increase the feed rate of tablets. Specifically and reference is made to FIG. 15 of the accompanying drawings, there is provided a disk 248 which is identical with the disk of FIG. 2 except that the outermost section of each slot which in FIG. 15 is designated by the reference numerals 38a is inclined relative to the radius of the disk 10° in the forward direction rather than 10° in the reverse direction. Since jams are almost completely eliminated by the arrangement of FIGS. 11 through 13 and may be essentially disregarded in practical operation, this arrangement is possible and due to the fact that the slot portion 38a is inclined 10° in the forward direction the feed rate of tablets is increased since rotation of the disk does not exert an outward drag on the tablets as in the disk of FIG. 2 thus decrease the rate. The 10° forward inclination of the slot 38a in fact causes the friction between the tablet and the platform 24a to increase the feed rate and it has been found that the rate of rotation of the motor may be increased as much as 10 revolutions per minute relative to the permissible rate of rotation when utilizing the disk of FIG. 2. Feed rates of 420 tablets per minute are now conventionally achieved with this arrangement.

The disk of FIG. 15 is in all other respects identical in each instance with the disk of FIG. 2 and the chart illustrated in FIG. 10 is valid except that the angle on the slot section 38 designated in FIG. 10 is 10° forward instead of 10° reverse.

Figure 16:
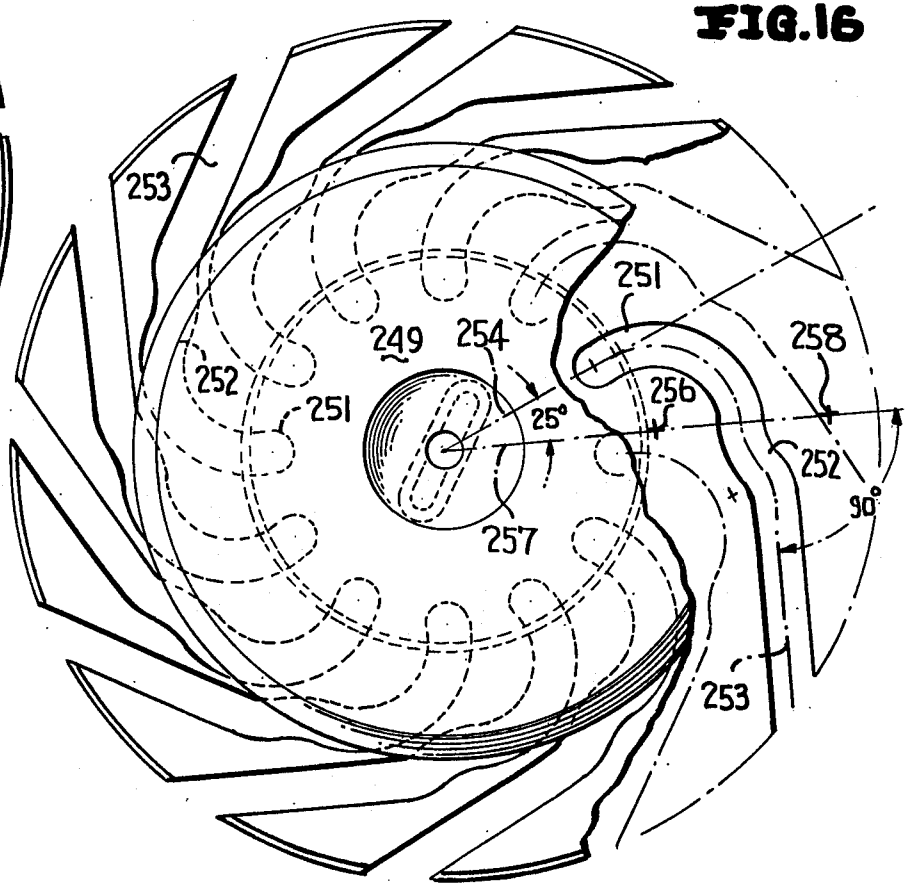
FIG. 16 is a preferred embodiment of a capsule dispensing disk.

Reference is now made to FIG. 16 for a preferred embodiment of the disk designed for capsules and it is intended to be used normally in preference to the disk illustrated in FIG. 7 of the accompanying drawings. Referring for the moment to the disk of FIG. 7 it has been found that capsules tend to be slowed down and perhaps bind to some extent at the intersection of the slot sections 60a and 60b. This binding action tended to slow down the rate of passage of the capsule through the slot and also to produce some last second "darters" which produce inaccuracies in the pill count.

The disk of FIG. 16 substantially eliminates this problem by providing a reverse curve at the intersection of the two innermost sections of the slot so as to provide smooth passage for the capsule which permits increasing the feed rate of capsules to 600 per minute. The design of the disk is identical for all size and types of capsules, the only difference between disks for various size capsules being the width and depth of the slot.

Referring now specifically to the construction of the disk and referring again to FIG. 16, the disk which is designated by reference numeral 249, again has a plurality of slots disposed circumferentially about the disk and extending generally radially inward. Each slot comprises three segments - an innermost segment 251, an intermediate segment 252 and an outermost segment 253. For purposes of discussion the innermost segment 251 of the slot has it centerline terminating along a radius which is designated by the reference numeral 254. The segment 251 is arcuate and has its center 256 located along a radius 257 disposed approximately 25° clockwise as illustrated in FIG. 16 from the radius 254. The centerline of the slot section 251 extends between the radii 254 and 257. The middle segment or section 252 of the slot has its center 258 also located along the radius 257 but is disposed outwardly of the intersection of the centerline of the segment 251 and the radius 257 so that the arc of this segment 252 is reversed relative to that of 251. The centerlines of the segments 251 and 252 are tangential at the radius 257.

The outermost slog segment 253 is straight and the centerline of the slot 253 lies at right angles to the radius 257 intersecting that radius at a point where the line or centerline of the slot section 253 is tangential to the outermost edge of the slot at the point where it crosses the radius 257. Each of the slot sections is symmetrical with respect to its centerline and although the slots have the same width the transition points between the slots 252 and 253 are rounded to provide smooth transitions therebetween and prevent and eliminate discontinuities in the path of movement of the capsule.

As previously indicated the slot configuration just described relative to FIG. 16 serves for all sizes and types of capsules, the only difference between disks for various capsules being the width of the slot. The utilization of this type of slot permits the cork screw action of the capsule movement through the slot to proceed against smooth continuous curves and allows the capsule to traverse the slot more quickly and to seat faster than in the prior design. Also the configuration substantially eliminates problems with last minute darters since when the slot, more particularly the innermost end of the slot section 251, is at the 2 o'clock position on the platform in which it is just about to engage the drop out slot at the 3 o'clock position, the segment 252 of the slot is almost vertically downward. A capsule in segment 252 cannot climb up this incline and is held out of the innermost section 251 so that it cannot arrive at the inner end of the total slot at about the time that the slot is being presented to the counting switch arm.

The section 253 of the slot is inclined forward about 115° relative to the radius 254 along which is disposed the innermost end of the slot and therefore the feed rate of capsules through the section is very rapid and imparts good momentum to the capsule for its rapid movement through the remainder of the slot. As previously indicated, the feed rates of 600 capsules per minute in this configuration are conventionally achieved.

A few general comments concerning the apparatus are in order. The inclination of the platform 24 of the drug cells should be about 40° relative to the horizontal. If the angle is much greater, the articles are not collected properly by the disk for conveyance to the upper region of the hopper and the feed rate materially reduced. The angle of about 40° has been found to be the angle which produces maximum feed rate. Relative to the slots in the disks the intersection of these slots may be rounded to provide a generally curved slot so long as the main sections of the slots conform to the angles set forth herein. It should be also noted that the microswitches may be replaced by other types of mechanical switches or by photoelectric or other types of remote sensing devices.

It should be noted that although the present invention is described as applicable to dispensing drugs, the principles of this invention are applicable to dispensing other types of discrete items.

Obviously the invention is susceptible to changes or alterations without defeating its practicability, therefore, we do not wish to be confined to the preferred embodiment shown in the drawings and described herein.

We claim:

1. In an article dispensing device having a support forming an inclined upper support surface, a drive shaft projection centrally upward through said upper support surface, means for rotating said drive shaft, said support having an article-passing opening therethrough, a switch having a switch arm mounted on the support adjacent the opening, and article counting means interconnecting a source of electrical energy with the means for rotating said drive shaft and said switch, the improvement comprising:

article dispensing hopper means overlying said upper surface, first means connecting said article dispensing hopper means with said drive shaft for rotation therewith, said support being movable axially of said drive shaft, said hopper dispensing means including a disk and an upstanding wall surrounding and connected with said disk at its depending edge, said disk forming the bottom of the hopper, said disk having a plurality of slot means selecting and discharging a succession of hopper contained articles through the article passing opening, and said first means connecting said article dispensing hopper means to said drive shaft for quick connect with and disconnect from said shaft, and means for biasing said support such that said upper support surface is biased into contact with said disk.

2. Structure as specified in claim 1 in which said disk is characterized by a relatively thin peripheral edge portion having a thickness approximately the same as the smallest dimension of articles to be counted and thicker central portion spaced from said upstanding wall a distance at least as great as the greatest dimension of articles to be counted.

3. Structure as specified in claim 2 in which the thickness of said thicker central portion of said disk is at least greater than the smallest dimension of articles to be counted, and in which the slot means includes a plurality of article receiving slots extending through said thin peripheral edge portion and under said thicker central portion in underlying downwardly open spaced relation with respect to the upper surface of said disk.

4. Structure as specified in claim 3 in which each article receiving slot extends inward from the periphery of said disk opposite the direction of its rotation, the innermost end portion of each slot being turned angularly inward toward the axis of said disk a distance at least as great as the greatest dimension of an article to be counted and terminating in that portion of said disk overlying the path of travel across the article passing opening.

5. Structure as specified in claim 3 in which the longitudinal axis of a part of each article receiving slot extends inward from the periphery of said disk opposite the direction of its rotation substantially tangential to a circle of a radius approximately equal to the distance of said switch arm from the center of said disk, the innermost end portion of each slot being further turned angularly inward toward the axis of said disk a distance at least as great as the greatest dimension of an article to be counted and intersecting said circle.

6. Structure as specified in claim 3 in which the longitudinal axis of a greater length portion of each article receiving slot extends inward from the periphery of said disk opposite the direction of its rotation on an acute angle with respect to a tangent to a circle of a radius approximately equal to the distance of said switch arm from the center of said disk, the innermost end portion of each slot being further turned angularly inward toward the axis of said disk a distance at least as great as the greatest dimension of an article to be counted and intersecting said circle.

7. Structure as specified in claim 1 wherein said inclined upper support surface is inclined approximately 40° with respect to the horizontal.

8. The combination according to claim 1 wherein said means for connecting said hopper to said shaft comprises a key-like member formed adjacent the end of said shaft and wherein said disk includes a key engaging member formed in the surface of said disk intended to contact said support surface.

9. An article of commerce to be employed to dispense individually discrete objects comprising a circular flat disk having a top surface and a bottom surface, said bottom surface having a plurality of slots extending inwardly from adjacent the periphery of said disk and equally spaced from one another along said bottom surface, each said slot having a first and a second slot section, said first slot section lying closer to the center of said disk than said second slot section and having a length greater than half the length of the objects to be dispensed, said first slot section having a central axis lying at an acute angle with respect to a radius of said disk intersecting said axis, said slot extending outwardly in the direction in which said disk is to be rotated in use, said second slot section extending outwardly from said first slot section at a larger angle relative to said radius than said first slot section.

10. Structure as specified in claim 9 wherein said acute angle is approximately 20°.

11. Structure as specified in claim 10 wherein said second slot section lies at an angle of approximately 55° to 60° relative to said first slot section.

12. Structure as specified in claim 11 wherein said slot further comprises a third slot section having an angle of approximately 10° relative to said radius, said third slot section extending inwardly from the periphery of said disk opposite to the direction in which said disk is intended to be rotated.

13. Structure as specified in claim 11 wherein said slot further comprises a third slot section having an angle of approximately 10° relative to said radius, said third slot section extending inwardly from the periphery of said disk in the direction in which said disk is intended to be rotated.

14. Structure as specified in claim 9 further comprising a slot forming an annulus intersection each of said first slot sections at a distance from their innermost ends by a distance slightly greater than half the length of the object to be dispensed by said disk.

15. Structure as specified in claim 9 wherein said second section lies at an angle of approximately 45° relative to said first slot section.

16. Structure as specified in claim 9 wherein said slot further comprises a third slot section lying adjacent the periphery of said disk, said third slot section lying at an angle relative to said second slot section such that the angle of said third slot section to said radius is approximately 100°.

17. Structure as specified in claim 9 wherein said upper surface includes a truncated conical section terminated toward the periphery of said disk at a distance from said bottom surface equal to the depth of said slot.

18. Structure as specified in claim 9 further comprising a generally semi-circular guard section intersecting said second slot section adjacent said first slot section and from the leading side of said second slot section relative to the intended direction of rotation of said disk.

19. Structure as specified in claim 18 wherein said acute angle is approximately 20°.

20. Structure as specified in claim 19 wherein said second slot section lies at an angle of approximately 55° relative to said first slot section.

21. Structure as specified in claim 9 wherein said slot further comprises a third slot section lying adjacent the periphery of said disk, said third slot section lying at an angle relative to said second slot section such that the angle of said third slot section to said radius is approximately 115°.

22. Structure as specified in claim 21 wherein said first and second slot sections are arcuate and have reverse curvatures relative to one another.

23. Structure as specified in claim 22 wherein the center of curvature of both said first and second slot sections lie along a radius lying at approximately 25° relative to a radius intersecting the centerline of said first slot section adjacent its inner end.

24. Structure as specified in claim 23 wherein the centerlines of said first and second slot sections are tangential at their point of intersection.

25. Structure as specified in claim 23 wherein the centerline of said third slot section is tangential to the outer edge of said second slot section at its inner end.

26. An apparatus for dispensing individually a predeterminable number of objects comprising a master control unit and a plurality of individual dispensing cells, each said dispensing cell including a disk having a plurality of slots for acquiring said objects and conveying them individually to a predetermined location, a platform upon which said disk is adapted to rest, said platform having an opening at said predetermined location whereby objects conveyed to said predetermined location may drop through said opening to said object delivery location, means for indicating when each object is delivered to said opening, a motor for rotating said disk to convey objects to said predetermined location, a starter circuit for selectively energizing said motor, and a motor holding circuit said master control unit including means for applying concurrently to said starter circuits of all said dispensing cells power for energizing said motors, each said dispensing cells including means responsive to actuation of said starter circuit for establishing said motor holding circuit for its associated motor and for generating a signal, and said master control unit further comprising means responsive to said signal from any one of said dispensing cells to remove power from said starter circuits of all of said dispensing cells and to apply power to all of said motor holding circuits.

27. Structure as specified in claim 26 wherein said master control unit further comprises means for predetermining a desired number of objects to be dispensed and means for deenergizing said motor when said desired number of objects has been dispensed.

28. Structure as specified in claim 27 wherein said means for deenergizing comprises means for counting the number of times said means for indicating is actuated and means responsive to an equality between said means for counting and said means for predetermining for deenergizing said motor and resetting said means for counting.

29. Structure as specified in claim 28 wherein said means for deenergizing said motor includes means for maintaining energization of said motor for a sufficient length of time to insure dropping of the last object to be dispensed through said opening in said platform.

30. Structure as specified in claim 28 wherein said master control unit further comprises means for preventing energization of any of said motors during resetting of said means for counting.

31. Structure as specified in claim 26 wherein said platform is inclined approximately 40° relative to the horizontal.

32. The combination according to claim 26 further comprising means associated with each of said cells for totalizing the number of times said means for indicating is actuated when each said cell is energized.

33. The combination according to claim 28 wherein said means for deenergizing said motor includes single means for maintaining energization of any selected motor for a length of time approximate that required for causing the last object counted to be dispensed through said opening in said platform and individually adjustable means associated with each of said cells for selectively maintaining energization of its associated motor for a sufficient time to insure said last object is dispensed.

34. The combination according to claim 27 wherein said means for deenergizing comprises means for counting the number of times said means for indicating is actuated and comprising energizing means for concurrently applying energizing voltage to a selected cell and said means for counting and means responsive to actuation of said energizing means for actuating said motor and said counting means.

35. An article dispensing device comprising an inclined support surface having an article receiving aperture therein, an article dispensing hopper having a bottom surface, a plurality of inwardly extending circumferentially arranged slots formed in said bottom surface of said article dispensing hopper, said slots extending from adjacent the periphery of said bottom surface toward the center thereof, said slots communicating with the interior of said article dispensing hopper adjacent the periphery thereof, means for rotating said article dispensing hopper so that said slots may be presented to said article receiving aperture sequentially and successively and means for resiliently biasing said bottom surface and said inclined support surface into engagement with one another.

36. Structure as specified in claim 35 wherein said means for resiliently biasing comprises an inclined base member, means for supporting said support surface above said base member for movement relative thereto, springs located between said support surface and said base member for urging said support surface away from said base member and means for holding said hopper against said support surface such as to compress said springs.

37. Structure as specified in claim 36 wherein said means for rotating said hopper comprises a motor having a shaft extending through said base member and said support surface, a key like member formed on the end of said shaft and wherein said means for holding comprises a key engaging member formed in the bottom of said hopper.

* * * * *